US009898992B2

(12) United States Patent
Liao

(10) Patent No.: US 9,898,992 B2
(45) **Date of Patent: *Feb. 20, 2018**

(54) AREA-SAVING DRIVING CIRCUIT FOR DISPLAY PANEL

(71) Applicant: SITRONIX TECHNOLOGY CORP., Hsinchu County (TW)

(72) Inventor: Min-Nan Liao, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 157 days.

This patent is subject to a terminal disclaimer.

(21) Appl. No.: 14/146,061

(22) Filed: Jan. 2, 2014

(65) Prior Publication Data

US 2014/0192095 A1 Jul. 10, 2014
US 2017/0345385 A9 Nov. 30, 2017

Related U.S. Application Data

(63) Continuation-in-part of application No. 14/113,609, filed as application No. PCT/CN2011/001089 on Jul. 1, 2011.

(60) Provisional application No. 61/748,829, filed on Jan. 4, 2013.

(51) Int. Cl.
*G09G 3/36* (2006.01)

(52) U.S. Cl.
CPC ..... *G09G 3/3696* (2013.01); *G09G 3/3688* (2013.01); *G09G 2310/027* (2013.01); *G09G 2320/0276* (2013.01); *Y10T 29/4913* (2015.01)

(58) Field of Classification Search
CPC ..... G09G 3/3688; G09G 3/3696; G09G 2310/027; G09G 2320/0276; Y10T 29/4913
See application file for complete search history.

(56) References Cited

U.S. PATENT DOCUMENTS

2003/0122766 A1 7/2003 Pulvirenti
2005/0200622 A1 9/2005 Yajima
2006/0132417 A1 6/2006 Shigenobu et al.
(Continued)

FOREIGN PATENT DOCUMENTS

CN 1645728 A 7/2005
CN 101814265 A 8/2010
(Continued)

*Primary Examiner* — Premal Patel
(74) *Attorney, Agent, or Firm* — Rosenberg, Klein & Lee

(57) ABSTRACT

The present invention relates to an area-saving driving circuit for a display panel, which comprises a plurality of digital-to-analog converting circuits convert input data, respectively, and produce a pixel signal. A plurality of driving units are coupled to the plurality of digital-to-analog converting circuits, respectively. They produce a driving signal according to the pixel signal and transmit the driving signal to the display panel for displaying. A plurality of voltage booster units are coupled to the plurality of driving units, respectively, and produce a supply voltage according to a control signal. Then the supply voltage is provided to the plurality of driving units. Thereby, by providing the supply voltage to the plurality of driving units of the display panel by means of the plurality of voltage booster units, the area of the external storage capacitor is reduced. Alternative, the external storage capacitor can be even not required.

14 Claims, 21 Drawing Sheets

(56) References Cited

U.S. PATENT DOCUMENTS

| | | | | |
|---|---|---|---|---|
| 2006/0267901 | A1 | 11/2006 | Maekawa | |
| 2006/0284806 | A1 | 12/2006 | Maki | |
| 2007/0268232 | A1 | 11/2007 | Ku et al. | |
| 2008/0036529 | A1 | 2/2008 | Ishiyama | |
| 2008/0084410 | A1 | 4/2008 | Uehara | |
| 2009/0079495 | A1* | 3/2009 | Morita | H02M 3/07 327/538 |
| 2010/0097361 | A1 | 4/2010 | Oku | |
| 2011/0148845 | A1* | 6/2011 | Uehara | G09G 3/3629 345/212 |
| 2013/0076716 | A1* | 3/2013 | Lim | G02F 1/1339 345/211 |

FOREIGN PATENT DOCUMENTS

| | | | |
|---|---|---|---|
| CN | 102063885 | A | 5/2011 |
| JP | 2003-216127 | A | 7/2003 |
| JP | 2004-187152 | A | 7/2004 |
| JP | 2006-338139 | A | 12/2006 |
| JP | 2008-209901 | A | 9/2008 |
| JP | 2008-292926 | A | 12/2008 |
| JP | 2010-26138 | A | 2/2010 |
| KR | 10-2004-0009573 | A | 1/2004 |
| KR | 10-1023346 | B1 | 3/2011 |
| TW | 501081 | B | 9/2002 |
| TW | 201035945 | A | 10/2010 |

* cited by examiner

AREA-SAVING DRIVING CIRCUIT FOR DISPLAY PANEL

REFERENCE TO RELATED APPLICATION

This application is being filed as a Continuation-in-Part of application Ser. No. 14/113,609, filed 24 Oct. 2013, currently pending.

FIELD OF THE INVENTION

The present invention relates generally to a driving circuit, and particularly to an area-saving driving circuit for a display panel.

BACKGROUND OF THE INVENTION

Modern technologies are developed prosperously. New information products are provided daily for satisfying people's various needs. The majority of early displays are cathode ray tubes (CRTs). Due to their huge size and power consumption as well as harmful radiation for long-term users, they are gradually replaced by liquid crystal displays (LCDs) at present. LCDs own the advantages of lightweight, small size, low radiation, and low power consumption. Thereby, they have become the mainstream in the market.

In addition, thanks to the rapid progress in the manufacturing technologies of panels in recent years, the manufacturing costs of touch panels has reduced significantly, making them widely applied to general consumer electronic products, such as the small-sized electronic appliances including mobile phones, digital cameras, digital music players (MP3), personal digital assistants (PDAs), and global positioning system (GPS). In these electronic commodities, touch panels are equipped and used as the displays and provides interactive input operations for users. Thereby, the friendliness of the human-machine interface is improved greatly and the input efficiency is enhanced.

In order to provide a larger range of power supply, such as 2.3V to 4.6V, for single-power applications as well as shrinking the area of the driving chips used for driving display panels, driving methods that can satisfy both requirements are proposed. The source driver of a general display device adopts operational amplifiers (Op-amps) or resistive voltage dividing for driving the display panel. Moreover, for making the housing smaller and easier to collocate, raising assembly yield, and reducing costs, shrinking external devices has become an important trend for single-chip liquid-crystal driving chip modules.

FIG. 1 shows a driving circuit for a display panel according to prior art. As shown in the figure, the driving circuit 1' comprises a plurality of digital-to-analog converting circuits 10' and a plurality of driving units 20'. The plurality of digital-to-analog converting circuits 10' receive input pixel data, respectively, and convert the input pixel data to a pixel signal. Then they transmit the pixel signal to the driving units 20' for producing a driving signal. The driving units 20' transmit the driving signal to the display panel 2' for displaying. The driving circuit 1' according to the prior art is connected externally to a voltage booster circuit 30'. For maintaining the level of the output signals of the digital-to-analog converting circuit 10', the voltage booster circuit 30' needs to couple to a storage capacitor 40'. Nonetheless, the capacitance of the storage capacitor 40' needs to be large (about 0.1 uF). Thereby, the storage capacitor 40' needs to adopt an external capacitor, which increases the manufacturing cost. If the storage capacitor 40' is disposed in the driving circuit 1', the area of the driving circuit 1' is increased.

Accordingly, the present invention provides a novel area-saving driving circuit for a display panel, which can shrink the area of the storage capacitor connected externally to the driving circuit. Alternatively, the external storage capacitor is even not required. Hence, the problems described above can be solved.

SUMMARY

An objective of the present invention is to provide an area-saving driving circuit for a display panel, which uses a plurality of voltage booster units to provide a supply voltage, respectively, to a plurality of driving units of a display panel for shrinking the area of the external storage capacitor. Alternative, the external storage capacitor can be even not required. Thereby, the purpose of saving circuit area can be achieved.

The area-saving driving circuit for a display panel according to the present invention comprises a plurality of digital-to-analog converting circuits, a plurality of driving units, and a plurality of voltage booster units. The plurality of digital-to-analog converting circuits convert input data, respectively, and produce a pixel signal. The plurality of driving units are coupled to the plurality of digital-to-analog converting circuits, respectively. They produce a driving signal according to the pixel signal and transmit the driving signal to the display panel for displaying. In addition, the plurality of voltage booster units are coupled to the plurality of driving units, respectively, and produce a supply voltage according to a control signal. Then the supply voltage is provided to the plurality of driving units. Thereby, by providing the supply voltage to the plurality of driving units of the display panel by means of the plurality of voltage booster units, the area of the external storage capacitor is reduced. Alternative, the external storage capacitor can be even not required. Hence, the purpose of saving circuit area can be achieved.

DETAILED DESCRIPTION

In the specifications and subsequent claims, certain words are used for representing specific devices. A person having ordinary skill in the art should know that hardware manufacturers may use different nouns to call the same device. In the specifications and subsequent claims, the differences in names are not used for distinguishing devices. Instead, the differences in functions are the guidelines for distinguishing. In the whole specifications and subsequent claims, the word "comprising" is an open language and should be explained as "comprising but not limited to". Beside, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

In order to make the structure and characteristics as well as the effectiveness of the present invention to be further understood and recognized, the detailed description of the present invention is provided as follows along with embodiments and accompanying figures.

Figure 1:
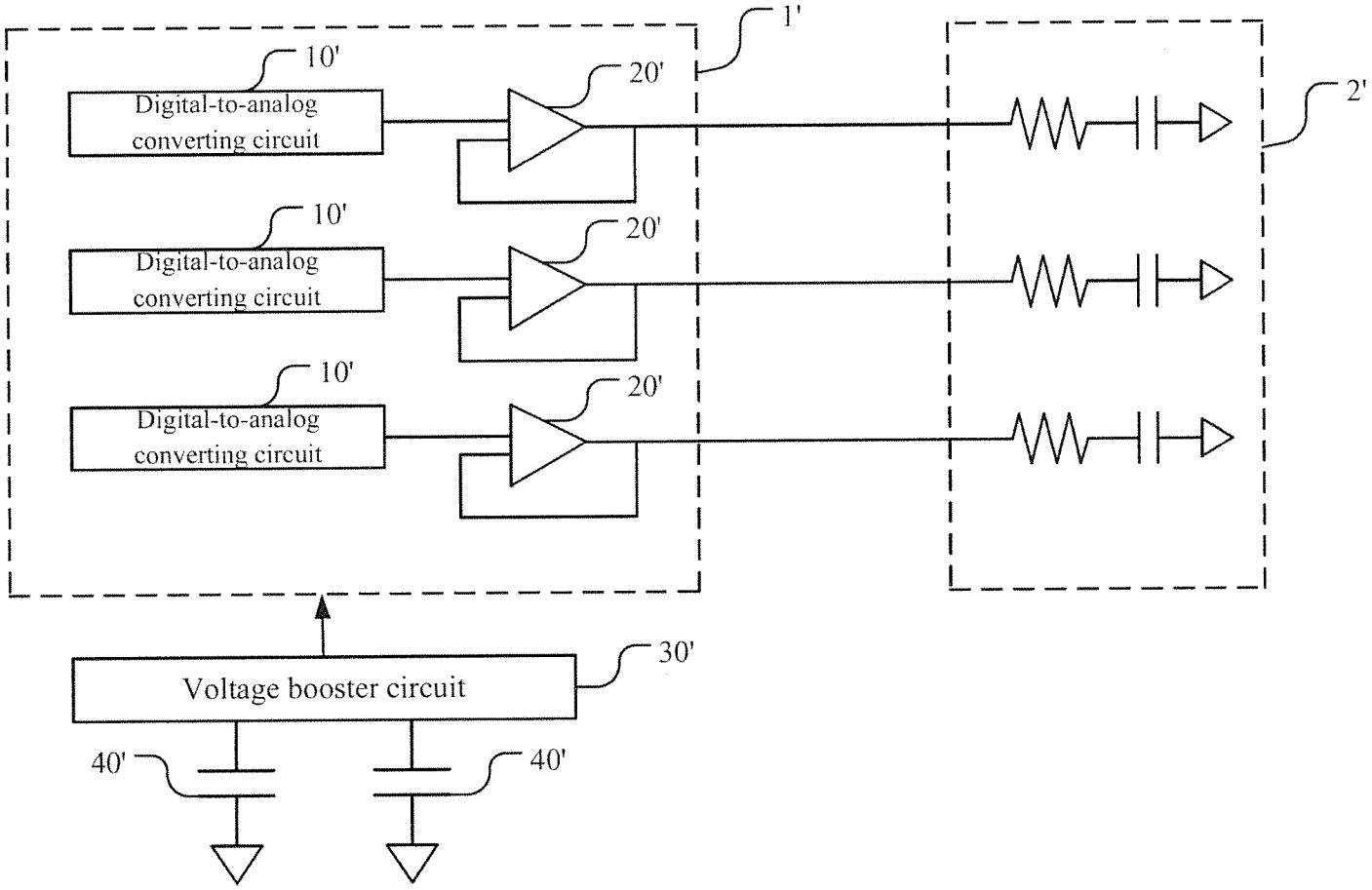
Figure 1 (Prior art)
FIG. 1 shows a driving circuit for a display panel according to prior art.
Figure 2:
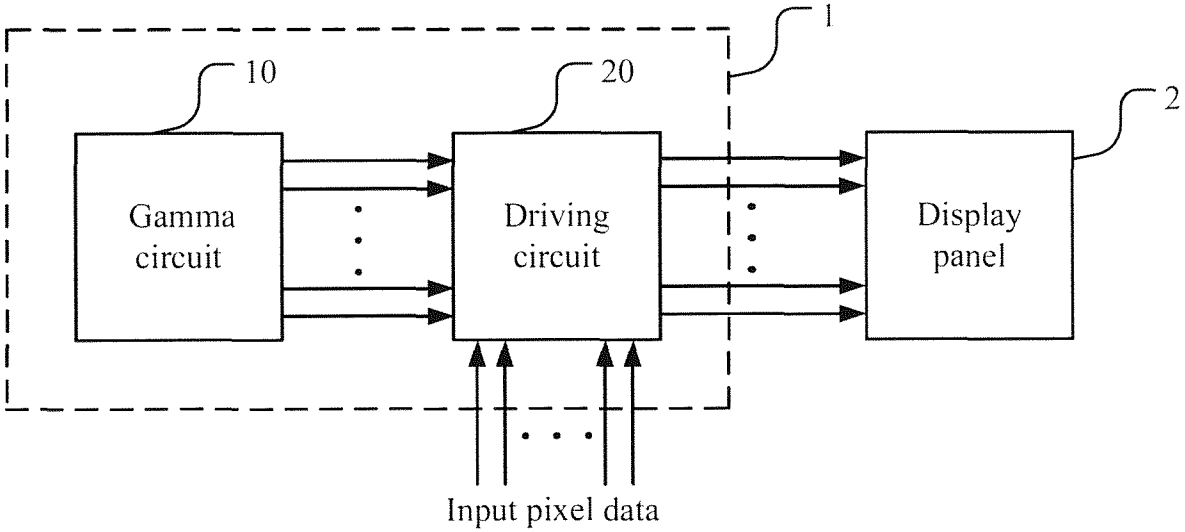
FIG. 2 shows a block diagram of the source driver according a preferred embodiment of the present invention.

FIG. 2 shows a block diagram of the source driver according a preferred embodiment of the present invention. As shown in the figure, the source driver 1 comprises a Gamma circuit 10 and a driving circuit 20. The Gamma circuit 10 produces a plurality of input signals according to a Gamma curve. The plurality of input signals are voltage signals having difference levels. The Gamma circuit 10 transmits the plurality of input signals to the driving circuit 20, which produces a plurality of driving signals, respectively, according to a plurality of input pixel data and the plurality of input signals. Then the driving circuit 20 transmits the plurality of driving signals to a display panel 2 for driving the display panel 2 to display.

Figure 3:
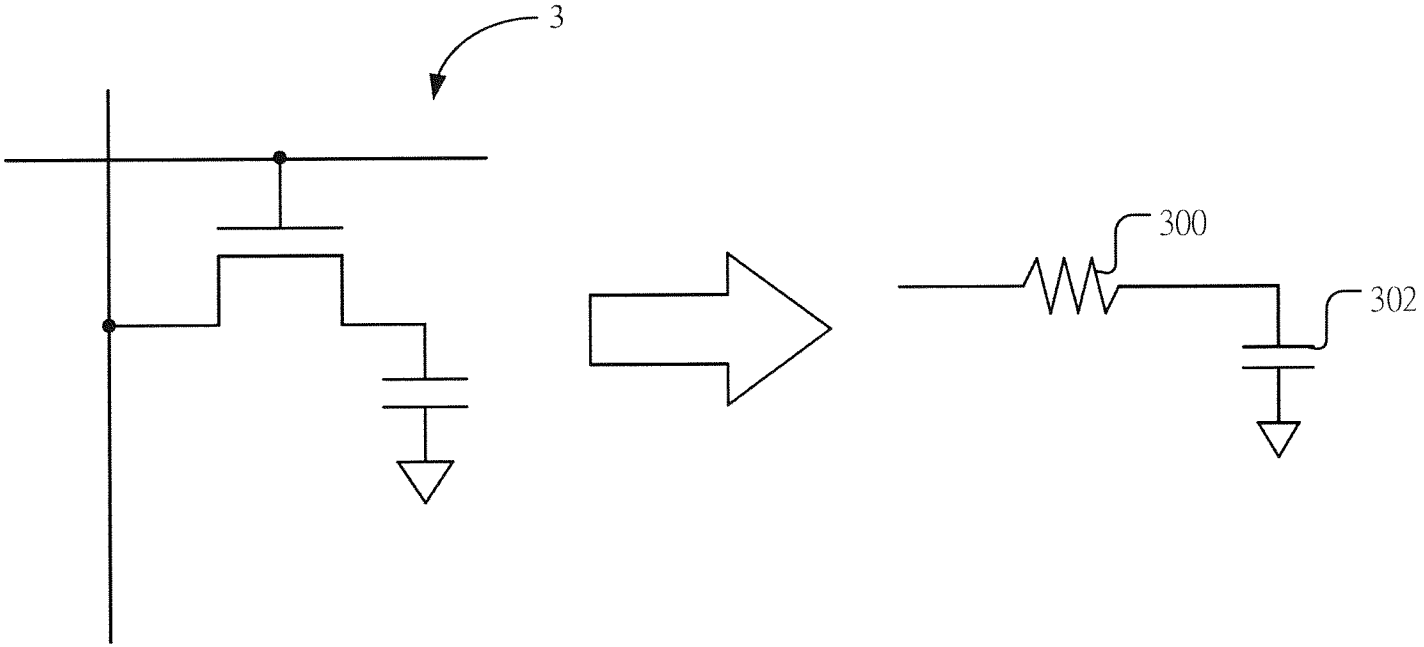
FIG. 3 shows the equivalent circuit for parasitic RC of the source line of the display panel according to the present invention.
Figure 4:
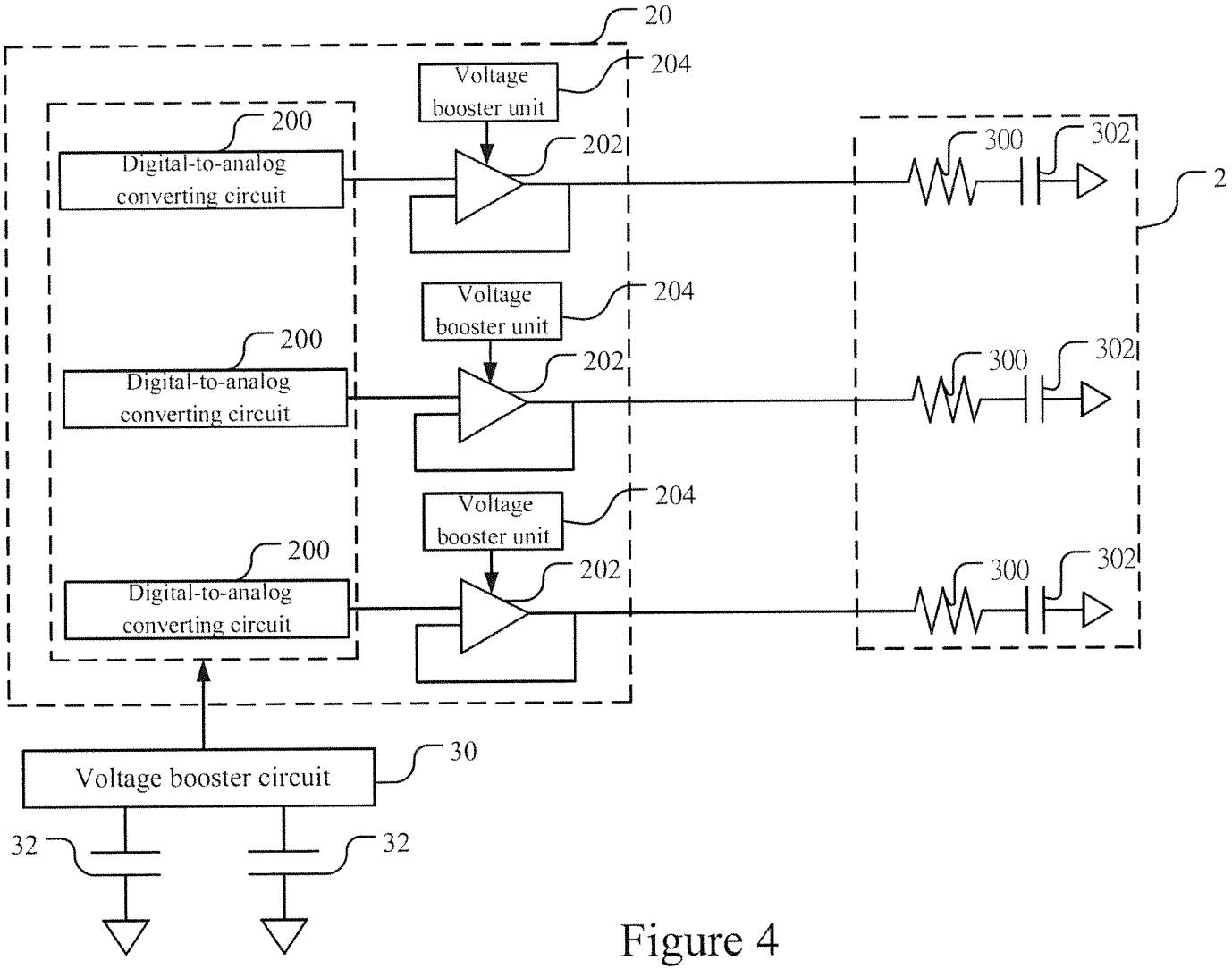
FIG. 4 shows a circuit diagram of the driving circuit according to a preferred embodiment of the present invention.

In addition, FIG. 3 shows the equivalent circuit for parasitic RC of the source line of the display panel according to the present invention. As shown in the figure, the display panel 2 according to the preferred embodiment of the present invention is a thin-film transistor liquid crystal display (TFT-LCD). The display panel 2 comprises a plurality of pixel structures 3, which are coupled to a plurality of driving units 202 of the driving circuit 20 (as shown in FIG. 4), respectively. Each pixel structure 3 on the source line of the display panel 2 is a thin-film transistor (TFT), and is equivalent to a resistor 300 connected in series with a capacitor 302. This is well known to a person having ordinary skill in the art, and hence will not be described in more details.

FIG. 4 shows a circuit diagram of the driving circuit according to a preferred embodiment of the present invention. As shown in the figure, the area-saving driving circuit 20 for a display panel according to the present invention comprises a plurality of digital-to-analog converting circuits 200, a plurality of driving units 202, and a plurality of voltage booster units 204. The plurality of digital-to-analog converting circuits 200 convert the input pixel data to a pixel signal, respectively. The plurality driving units 202 are coupled to the plurality of digital-to-analog converting circuits 200, respectively. The plurality of driving units 202 produce a driving signal according to the pixel signal and transmit the driving signal to the display panel 2 for displaying. According to the present embodiment, the plurality of driving units 202 amplify the pixel signals output by the digital-to-analog converting circuit 200 for producing the driving signals. The plurality of voltage booster units 204 are coupled to the plurality of driving units 202, respectively, and produce a supply voltage according to a control signal. Besides, the plurality of voltage booster units 204 provide the plurality of supply voltages to the plurality of driving units 202, respectively, so that the plurality of driving units 202 can produce the driving signals for driving the display panel 2 to display. The plurality of driving units 202 are Op-amps. According to the present invention, the plurality of voltage booster units 204 provide supply voltages to the plurality of driving units 202 of the display panel 2, respectively. Thereby, the area of the external storage capacitor is shrunk. Alternatively, the external storage capacitor can be not required. The purpose of saving circuit area is thus achieved. The control signals received by the plurality of driving units 202 can be generated by any control circuit inside the display panel 2 and transmitted to the plurality of voltage booster units 204. This is well known to a person having ordinary skill in the art, and hence will not be described in more details.

Moreover, the area-saving driving circuit 20 for a display panel is further coupled to a voltage booster circuit 30, which is coupled to the plurality of digital-to-analog converting circuits 200 and provides the supply voltage to the plurality of digital-to-analog converting circuits 200. In addition, the voltage booster circuit 30 is further coupled to a storage capacitor 32 for stabilizing the supply voltage output by the voltage booster circuit 30. Nonetheless, because the plurality of driving units 202 consumes most power of the driving circuit 20, the capacitance of the storage capacitor 32 required by the voltage booster circuit 30 can be significantly smaller. Thereby, the area of the storage capacitor 32 is shrunk greatly, and hence achieving the purpose of saving the circuit area of the driving circuit 20. According to the present invention, more than 50% of the area of the driving circuit 20 can be saved.

Besides, according to the present invention, because the plurality of voltage booster units 204 provide supply voltage to the plurality of driving units 202 of the display panel, respectively, the area for the storage capacitor can be saved significantly or even no storage capacitor is required. Thereby, the voltage booster circuit 30 can be disposed in the driving circuit 20 (not shown in the figure).

Figure 5:
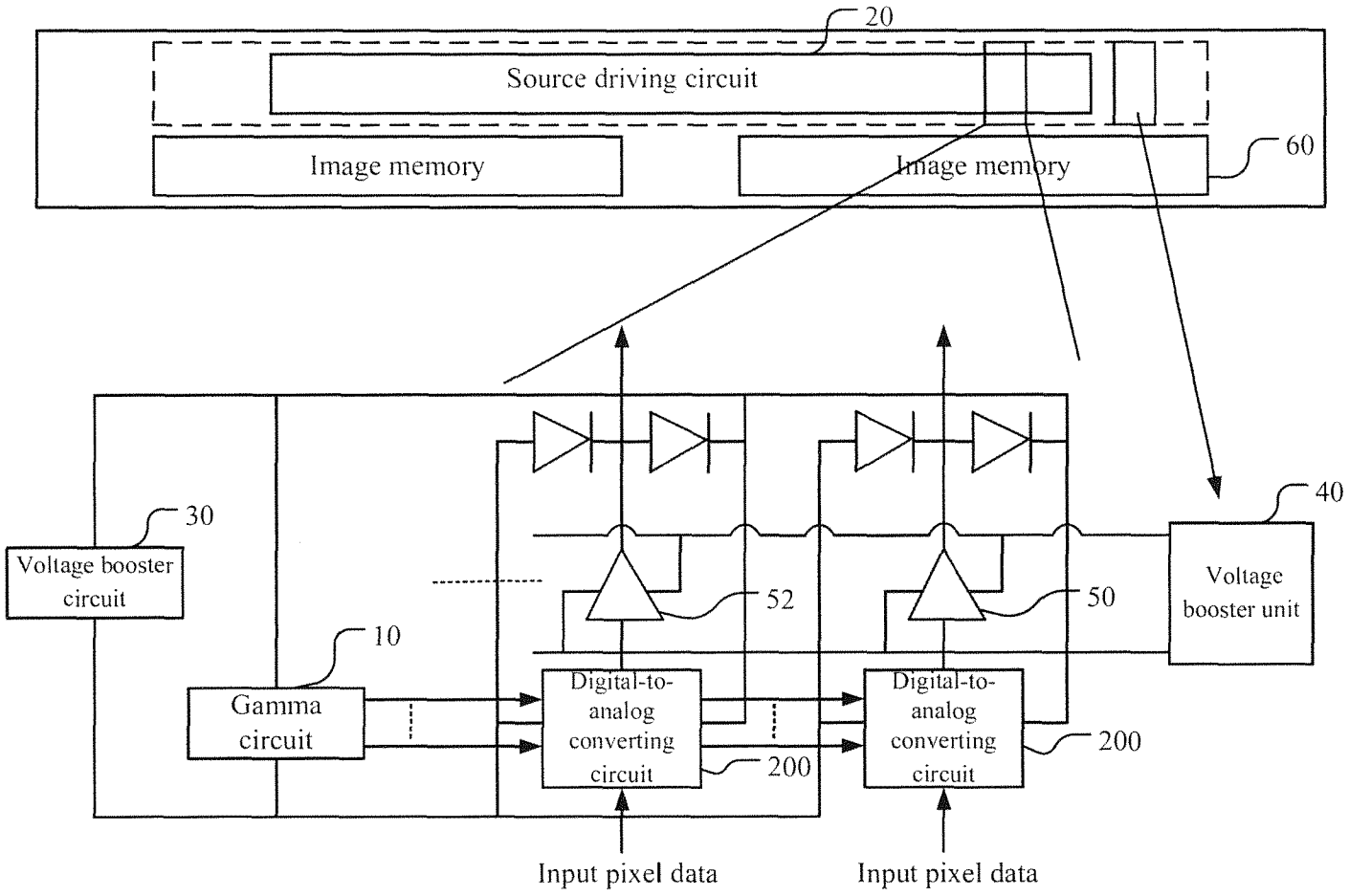
FIG. 5 shows a circuit diagram of the driving circuit according to another preferred embodiment of the present invention.

FIG. 5 shows a circuit diagram of the driving circuit according to another preferred embodiment of the present invention. As shown in the figure, the difference between the present embodiment and the previous one is that a voltage booster unit 40 according to the present embodiment not only provides voltage for a single driving unit but can also voltage for two or three driving units. As shown in FIG. 5, the voltage booster unit 40 according to the present embodiment is coupled to a first driving unit 50 and a second driving unit 52. The voltage booster unit 40 produces supply voltage to the first and the second driving units 50, 52 for supplying the power they need. Thereby, the area for the storage capacitor can be reduced or even no storage capacitor is required, and hence achieving the purpose of saving the circuit area. In addition, the number of the driving units can be reduced, and hence achieving the purposes of saving circuit areas as well costs. Furthermore, the voltage booster unit 40 according to the present embodiment can be disposed on the top boundary of the side of the driving unit 50 and located above the image memories 60.

Figure 6:
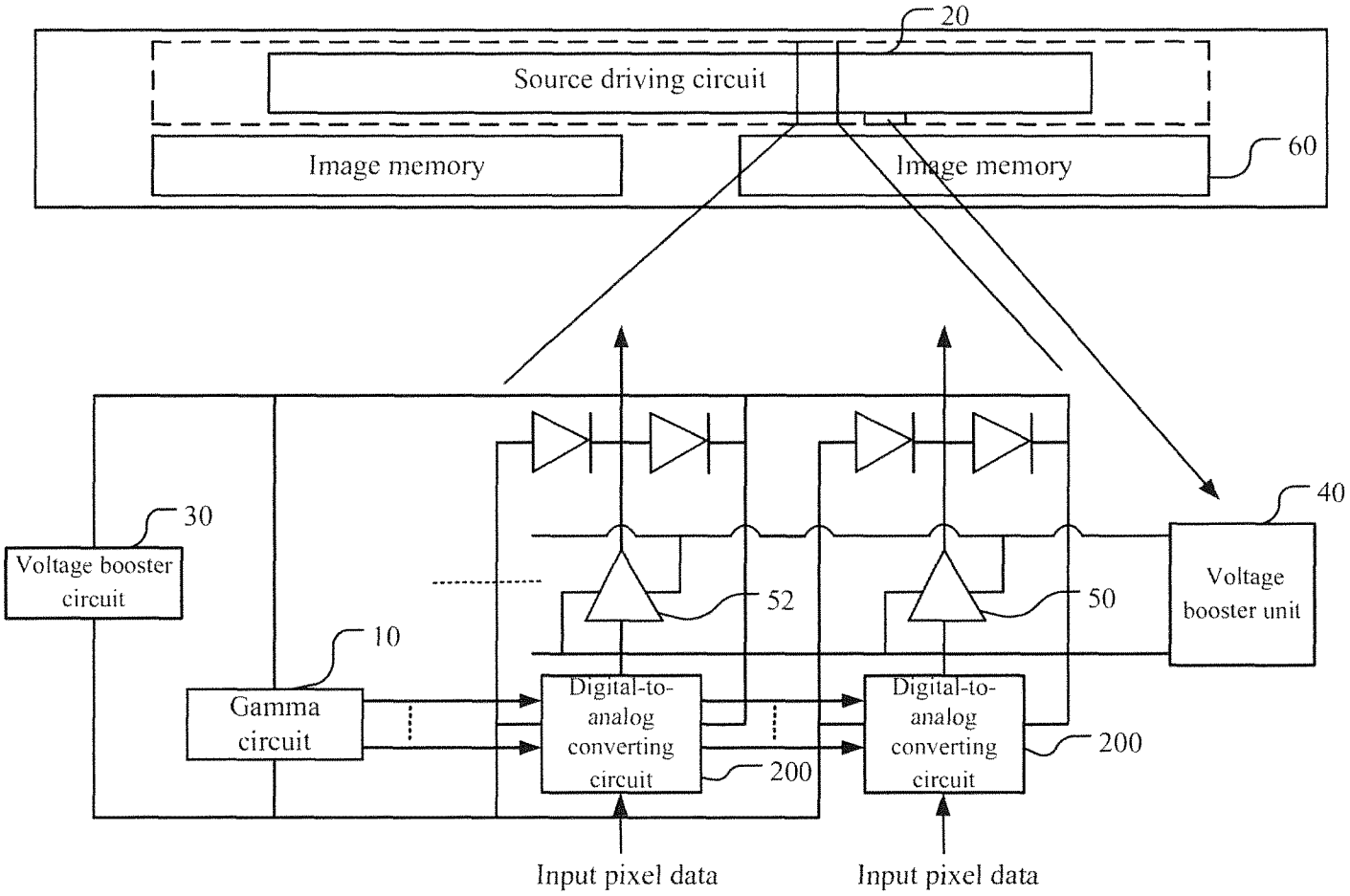
FIG. 6 shows a circuit diagram of the driving circuit according to another preferred embodiment of the present invention.

FIG. 6 shows a circuit diagram of the driving circuit according to another preferred embodiment of the present invention. As shown in the figure, the difference between the present embodiment and the one in FIG. 5 is that the voltage booster unit 40 according to the present embodiment can be arranged from one voltage booster unit supplying power for multiple driving units to at least one voltage booster unit supplying power for one driving unit (as the voltage boost units shown in FIG. 4). Thereby, the circuit of the voltage boost units 40 can be arranged along with the circuits of the driving units 50, 52 between the boundary of the side chips of the source driver 20 and the image memories 60.

Figure 7:
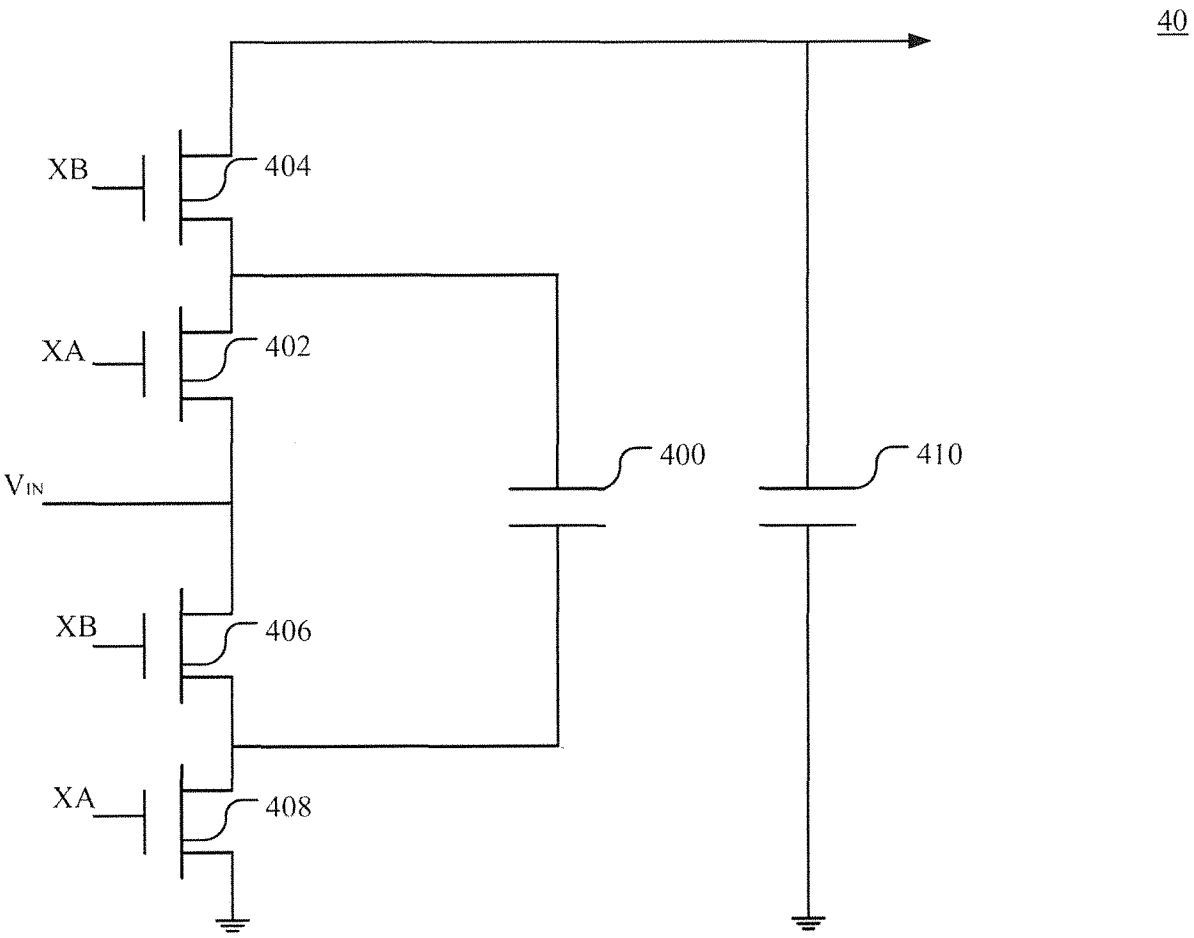
FIG. 7 shows a circuit diagram of the voltage booster unit according to a preferred embodiment of the present invention.

FIG. 7 shows a circuit diagram of the voltage booster unit according to a preferred embodiment of the present invention. As shown in the figure, the voltage booster unit 40 according to the present invention can be a capacitive voltage booster circuit, and comprises a flying capacitor 400, a first transistor 402, a second transistor 404, a third transistor 406, a fourth transistor 408, and a storage capacitor 410. The flying capacitor 400 is used for producing the supply voltage. One terminal of the first transistor 402 is coupled to the one terminal of the flying capacitor 400. Another terminal of the first transistor 402 receives an input voltage $V_{IN}$ and is controlled by a first control signal XA. The second transistor 404 is coupled to the flying capacitor 400 and the first transistor 402 and controlled by a second control signal XB for outputting the supply voltage. One terminal of the third transistor 406 is coupled to the other terminal of the flying capacitor 400. Another terminal of the third transistor 406 receives the input voltage $V_{IN}$ and is controlled by the second control signal XB. One terminal of the fourth transistor 408 is coupled to the flying capacitor 400 and the third transistor 406. Another terminal of the fourth transistor 408 is coupled to the ground and controlled by the first control signal XA. One terminal of the storage capacitor 410 is coupled to the second transistor 404. The other terminal of the storage capacitor 410 is coupled to the ground for storing and outputting the supply voltage. Thereby, after the voltage booster unit 40 according to the present embodiment receives the input voltage $V_{IN}$, the first and the second control signals XA, XB are used for controlling the first to the fourth transistors 402, 404, 406, 408 for producing and outputting the supply voltage to the driving units 50, 52.

Figure 8:
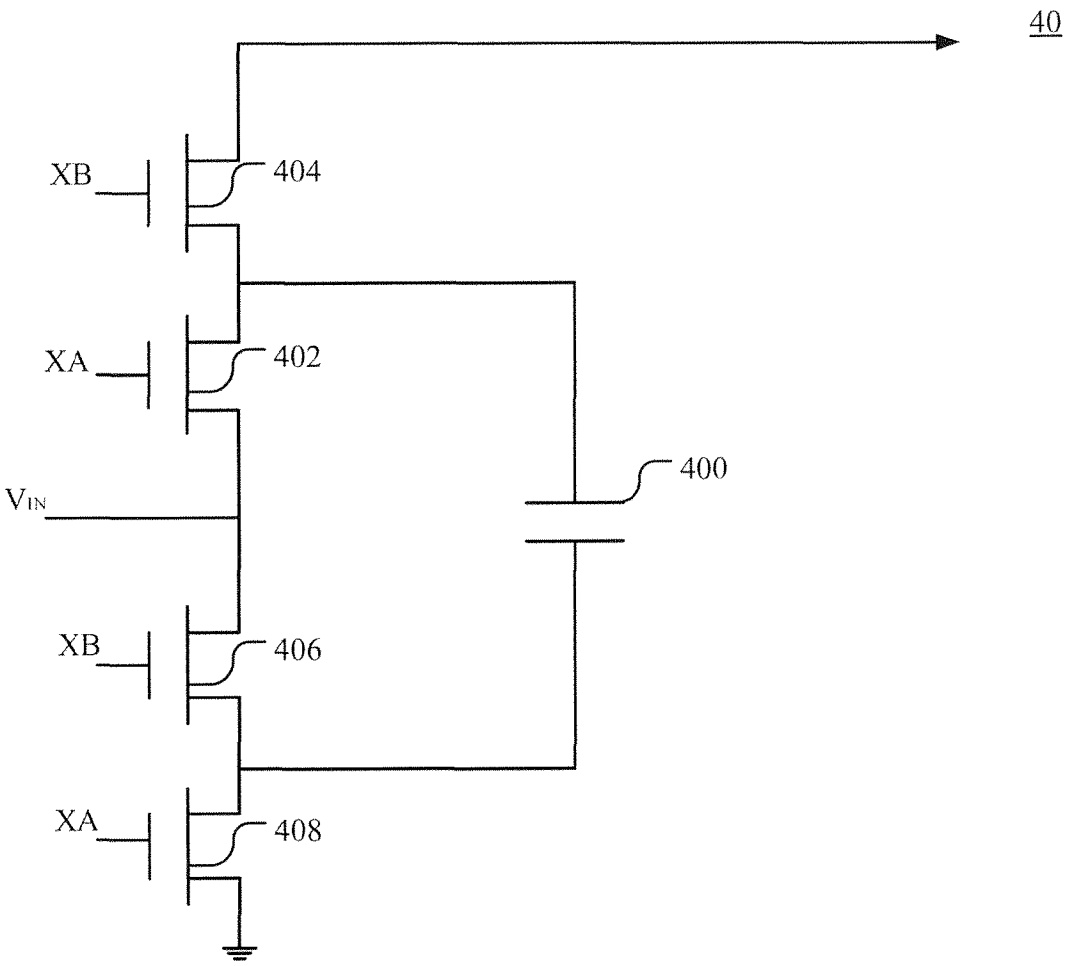
FIG. 8 shows a circuit diagram of the voltage booster unit according to another preferred embodiment of the present invention.

FIG. 8 shows a circuit diagram of the voltage booster unit according to another preferred embodiment of the present invention. As shown in the figure, the difference between the present embodiment and the one in FIG. 7 is that the voltage booster unit 40 according to the present embodiment needs no storage capacitor 410. Because the voltage booster unit 40 according to the present invention is used for providing the supply voltage for the driving units 50, 52, which only drive the panel (such as the display panel 2 in FIG. 4) but do not have the function of maintaining an accurate reference voltage for the digital-to-analog converting circuit (such as the digital-to-analog converting circuit 200 in FIG. 4), the power supply is allowed to oscillate significantly under the circumstance of no storage capacitor. Thereby, the voltage booster unit 40 according to the present embodiment needs only the flying capacitor 400 but not the storage capacitor for producing the supply voltage and supplying the power required by the driving units 50, 52. Accordingly, the purpose of reducing the circuit area and hence the costs can be achieved.

Figure 9:
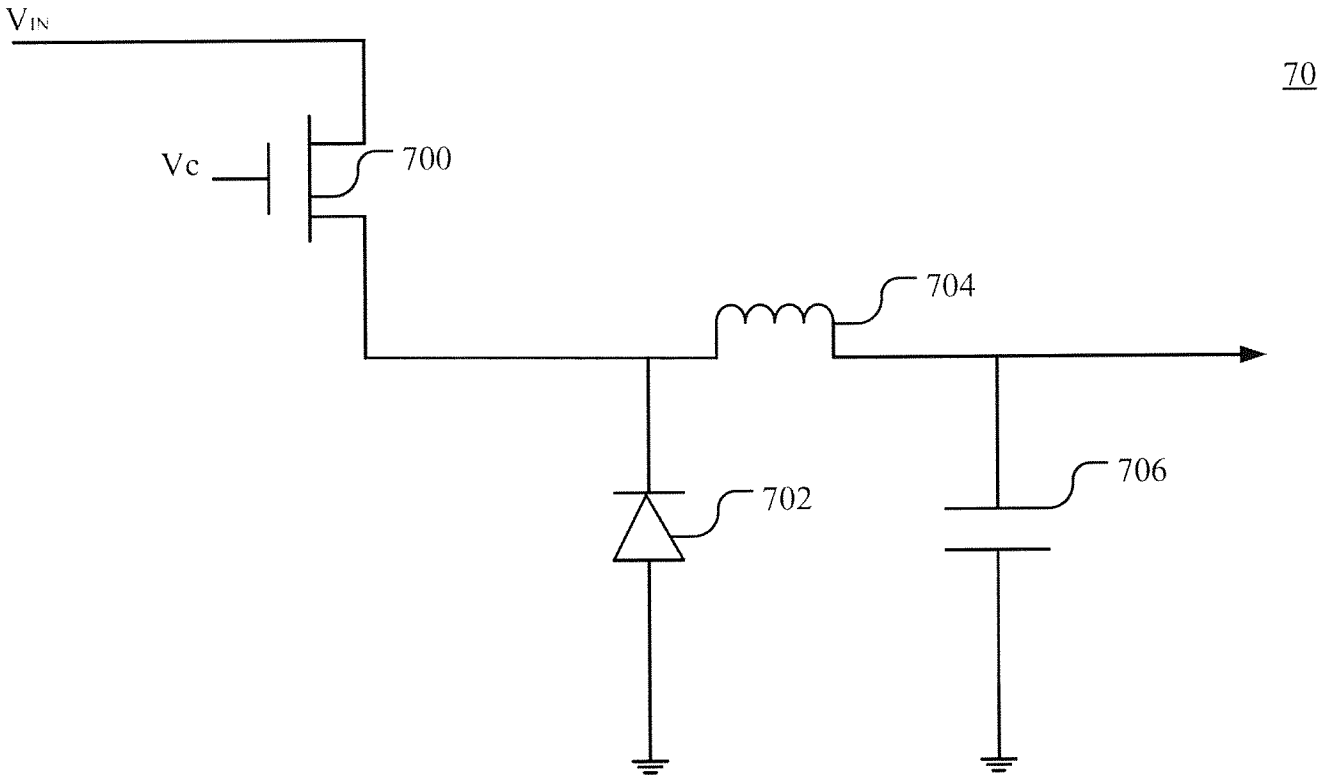
FIG. 9 shows a circuit diagram of the voltage booster unit according to another preferred embodiment of the present invention

FIG. 9 shows a circuit diagram of the voltage booster unit according to another preferred embodiment of the present invention. As shown in the figure, the difference between the voltage booster unit 70 according to the present embodiment and the voltage booster units 40 in FIG. 7 and FIG. 8 is that that voltage booster unit 70 according to the present embodiment is an inductive voltage booster unit. The voltage booster unit 70 according to the present embodiment comprises a control transistor 700, a diode 702, a storage inductor 704, and an output capacitor 706. One terminal of the control transistor 700 receives the input voltage $V_{IN}$ and is controlled by a control signal $V_C$. One terminal of the diode 702 is coupled to the control transistor 700 while the other terminal thereof is coupled to the ground. The storage inductor 704 is coupled to the control transistor 700 and the diode 702 for storing the energy of eh input voltage $V_{IN}$. One terminal of the output capacitor 706 is coupled to the storage inductor 704 while the other terminal thereof is coupled to the ground for storing the energy of eh input voltage $V_{IN}$ and producing the supply voltage and outputting tot eh driving units 50, 52.

Figure 10:
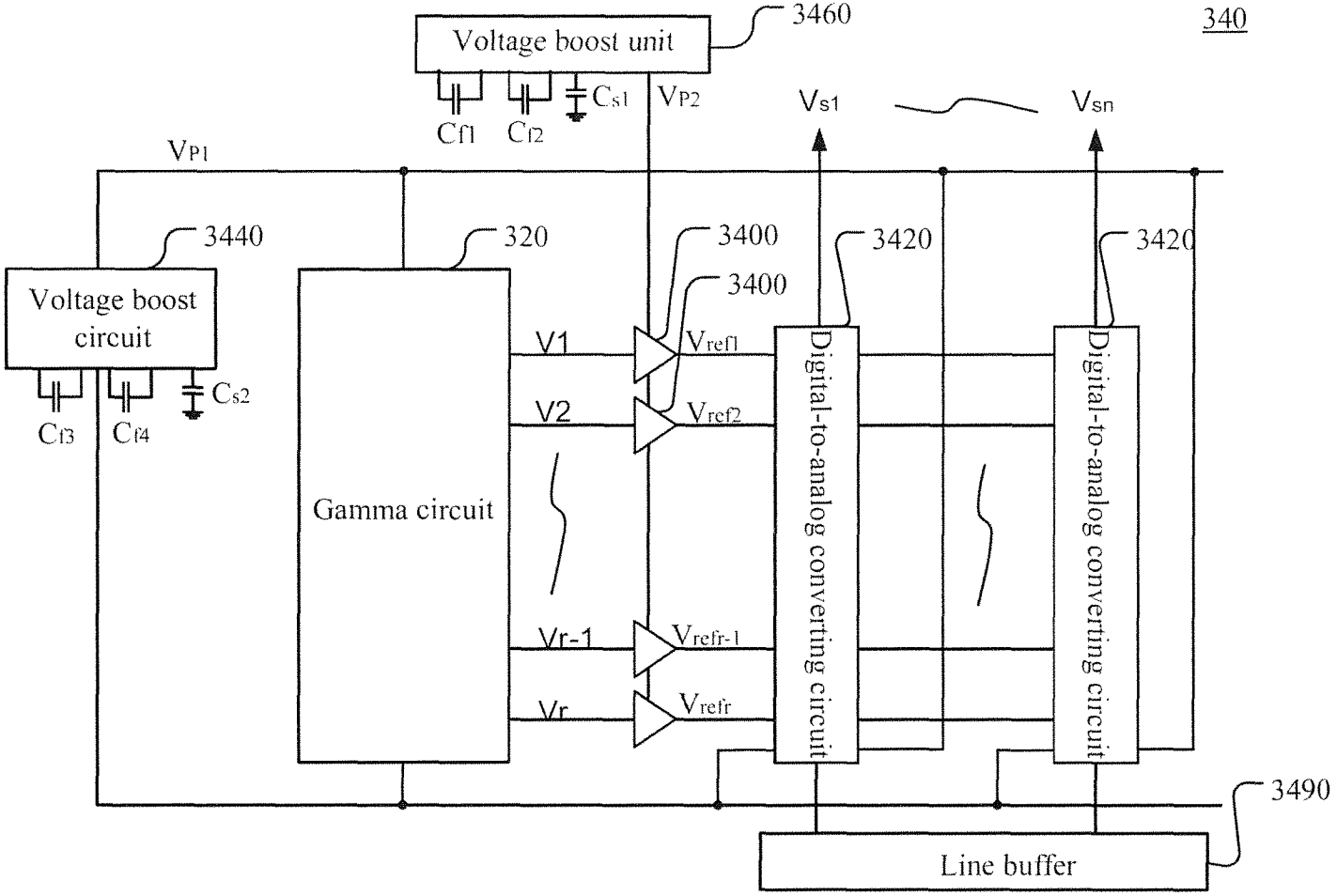
FIG. 10 shows a block diagram of the driving circuit of the display panel according to a first embodiment of the present invention.

Please refer to FIG. 10, which shows a block diagram of the driving circuit of the display panel according to a first embodiment of the present invention. As shown in the figure, the driving circuit 340 of the display panel 2 according to the present invention comprises a plurality of driving units 3400, a plurality of digital-to-analog converting circuits 3420, a voltage boost circuit 3440, and at least a voltage boost unit 3460. The plurality of driving units 3400 are coupled to the gamma circuit 320. The plurality of driving units 3400 produce a reference driving voltage according to the gamma voltages $V_1$~$V_r$ of the gamma circuit 320, respectively. Namely, a plurality of output lines of the gamma circuit 320 are coupled to the plurality of driving units 3400, respectively. The gamma circuit 320 transmits the plurality of gamma voltages $V_1$~$V_r$ to the plurality of driving units 3400 via the plurality of output lines, drives the plurality of driving units 3400 to produce a plurality of reference driving voltages $V_{ref1}$~$V_{refr}$, respectively, and transmits the plurality of reference driving voltages $V_{ref1}$~$V_{refr}$ to the plurality of digital-to-analog converting circuits 3420.

The plurality of digital-to-analog converting circuits 3420 are coupled to the plurality of driving units 3400, receive the plurality of reference driving voltages $V_{ref1}$~$V_{refr}$ and the plurality of pixel data transmitted by the plurality of driving units 3400, and select one of the plurality of reference driving voltages $V_{ref1}$~$V_{refr}$ as a data driving voltage $V_s$. The plurality of digital-to-analog converting circuits 3420 transmit the plurality of data driving voltages $V_{s1}$~$V_{sn}$ to the display panel 2 for displaying images. That is to say, each digital-to-analog converting circuit 3420 will receive the plurality of reference driving voltages $V_{ref1}$~$V_{refr}$ and select one of the plurality of reference driving voltages $V_{ref1}$~$V_{refr}$ as the data driving voltage $V_s$. Thereby, the plurality of digital-to-analog converting circuits 3420 produce the plurality of data driving voltages $V_{s1}$~$V_{sn}$ and transmit the plurality of data driving voltages $V_{s1}$~$V_{sn}$ to the display panel 5 for displaying images. The plurality of pixel data can be provided by a line buffer 3490. Alternatively, as shown in FIG. 2, they can be provided by the inputs of the driving circuit 340.

The voltage boost circuit 3440 is coupled to the gamma circuit 320 and the plurality of digital-to-analog converting circuits 3420. In addition, the voltage boost circuit 3440 is used for producing a first supply voltage $V_{P1}$ and providing the first supply voltage $V_{P1}$ to the gamma circuit 320 and the plurality of digital-to-analog converting circuits 3420. At least a voltage boost unit 3460 is coupled to the plurality of driving units 3400, and used for producing a second supply voltage $V_{P2}$ and providing the second supply voltage $V_{P2}$ to the plurality of driving unit 3400. According to the present embodiment, only a voltage boost unit 3460 is used for producing the second supply voltage $V_{P2}$ and providing the second supply voltage $V_{P2}$ to the plurality of driving units 3400. The voltage boost unit 3460 is coupled to the flying capacitors $C_{f1}$, $C_{f2}$ and the storage capacitor $C_{s1}$; the voltage boost circuit 344 is coupled to the flying capacitors $C_{f3}$, $C_{f4}$ and the storage capacitor $C_{s2}$. According to the above description, the plurality of driving units 3400 and the plurality of digital-to-analog converting circuits 3420 can have individual power supplies; the gamma circuit 320 and the plurality of digital-to-analog converting circuits 3420 can have individual power supplies. Accordingly, by providing individual voltages to the corresponding devices using the plurality of voltage boost units 3460 and the voltage boost circuit 3440, the areas of the external storage capacitors $C_{s1}$, $C_{s2}$ can be shrunk or the external storage capacitor $C_{s1}$ can be even eliminated. Thus, the purpose of saving circuit area can be achieved.

Besides, because the number of the source lines of the display panel is greater than the number of the output lines of the gamma circuit 320, according to the present embodiment, the usage of the plurality of driving units 3400 can be reduced by disposing the plurality of driving units 3400 between the gamma circuit 320 and the plurality of digital-to-analog converting circuits 3420, namely, by disposing the plurality of driving units 3400 at the output lines of the gamma circuit 320. Consequently, the circuit area is reduced and thus achieving the purpose of saving cost.

Moreover, the driving circuit according to the present invention further comprises a line buffer 3490 used for buffering the plurality of pixel data and transmitting the plurality of pixel data to the plurality of digital-to-analog converting circuits 3420.

Figure 11:
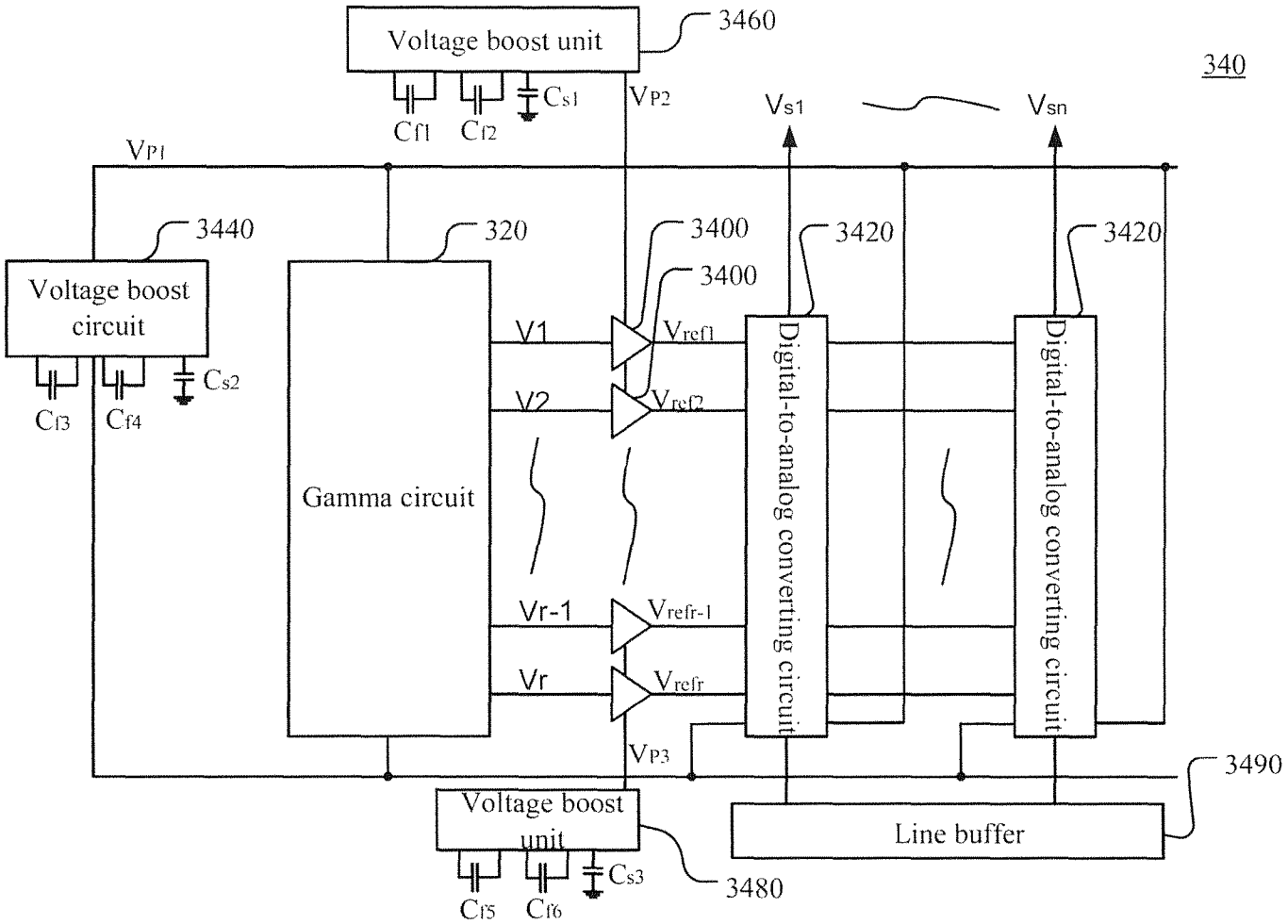
FIG. 11 shows a block diagram of the driving circuit of the display panel according to a second embodiment of the present invention.

Please refer to FIG. 11, which shows a block diagram of the driving circuit of the display panel according to a second embodiment of the present invention. As shown in the figure, the difference between the present embodiment and the one in FIG. 10 is that two voltage boost units 3460, 3480 are used in the present embodiment. The voltage boost units 3460, 3480 produce the second supply voltage $V_{P2}$ and a third supply voltage $V_{P3}$, respectively. The voltage boost unit 3460 transmits the second supply voltage $V_{P2}$ to first half of the plurality of driving units 3400, while the voltage boost unit 348 transmits the third supply voltage $V_{P3}$ to second half of the plurality of driving units 3400. In addition, it is not required that the voltage boost units 3460, 3480 are responsible for a half of the plurality of driving units 3400, respectively. They can be responsible for different proportions of the plurality of driving units 3400. For example, the voltage boost unit 3460 is responsible for the first one-third of the plurality of driving units 3400, while the voltage boost unit 3480 is responsible for the remaining two-thirds of the plurality of driving units 3400. Alternatively, the voltage boost unit 3460 is responsible for the first quarter of the plurality of driving units 3400, while the voltage boost unit 3480 is responsible for the remaining three quarters of the plurality of driving units 3400.

Beside, the present invention is not limited to using one or two voltage boost units. The scope of present invention ranges from one voltage boost unit corresponding to the plurality of driving units 3400 to one voltage boost unit corresponding to one driving unit 3400.

Figure 12:
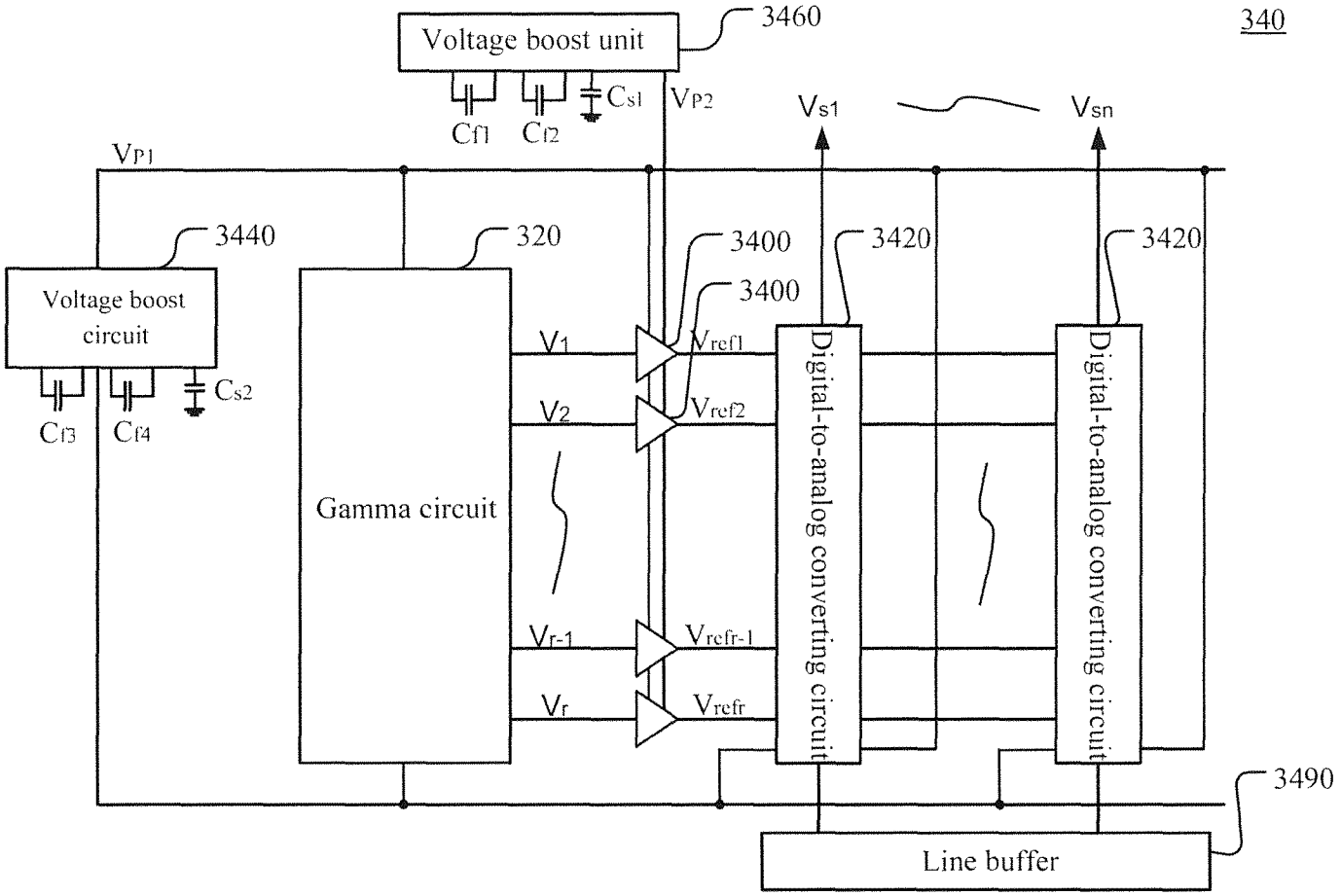
FIG. 12 shows a block diagram of the driving circuit of the display panel according to a third embodiment of the present invention.
Figure 13:
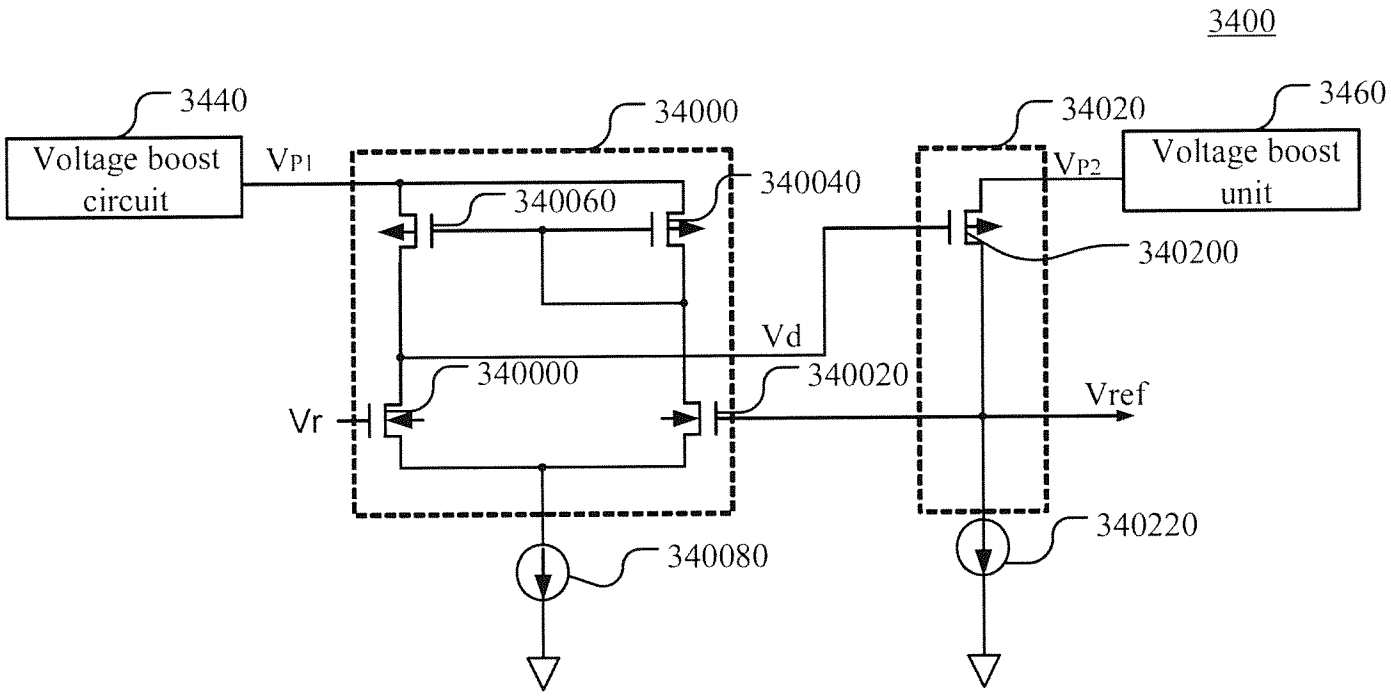
FIG. 13 shows a circuit diagram of the driving unit according a first embodiment of the present invention.

Please refer to FIG. 12 and FIG. 13. FIG. 12 shows a block diagram of the driving circuit of the display panel according to a third embodiment of the present invention; FIG. 13 shows a circuit diagram of the driving unit according a first embodiment of the present invention. As shown in the figures, the difference between the present embodiment and the one in FIG. 10 is that the plurality of driving units 3400 according to the present embodiment receive the first supply voltage $V_{P1}$ produced by the voltage boost circuit 3440 and the second supply voltage $V_{P2}$ produced by the voltage boost unit 3460 simultaneously. As shown in FIG. 13, the driving unit 3400 according to the present invention comprises a differential unit 34000 and an output unit 34020. The differential unit 34000 receives the first supply voltage $V_{P1}$, uses it as the power supply of the differential unit 34000, and producing a differential voltage $V_d$ according to the gamma voltage 320. The output unit 34020 receives the second supply voltage $V_{P2}$, uses it as the power supply of the output unit 34020, and producing the reference driving voltage $V_{ref}$ according to the differential voltage $V_d$.

The differential unit 34000 according to the present embodiment comprises a transistor 340000, a transistor 340020, a transistor 340040, a transistor 340060, and a current source 340080. The gate of the transistor 340000 is coupled to the output of the gamma circuit 320 for receiving the gamma voltage output by the gamma circuit 320. A first terminal of the transistor 340000 is coupled to a first terminal of the transistor 340020. The gate of the transistor 340020 is coupled to the output of the driving unit 3400. A second terminal of the transistor 340020 is coupled to a first terminal of the transistor 340040. A second terminal of the transistor 340040 is coupled to the power supply for receiving the first supply voltage $V_{P1}$ provided by the voltage boost circuit 3440. The gate of the transistor 340040 is coupled to the gate of the transistor 340060 and the first terminal of the transistor 340040. A first terminal of the transistor 340060 is coupled to a second terminal of the transistor 340000. A second terminal of the transistor 340060 is coupled to the power supply for receiving the first supply voltage $V_{P1}$ provided by the voltage boost circuit 3440. A first terminal of the current source 340080 is coupled to the first terminal of the transistor 340000 and the first terminal of the transistor 340020. A second terminal of the current source 340080 is coupled to the reference voltage.

In addition, the output unit 34020 according to the present embodiment comprises a transistor 340400 and a current source 340220. The gate of the transistor 340400 is coupled to the second terminal of the transistor 340000 and the first terminal of the transistor 340060. The first terminal of the transistor 340200 is coupled to the output of the driving unit 3400. The second terminal of the transistor 340200 is couple to the power supply for receiving the second supply voltage $V_{P2}$ provided by the voltage boost unit 3460. A first terminal of the current source 340220 is coupled to the output of the driving unit 3400. A second terminal of the current source 340220 is coupled to the reference voltage. The differential units 34000 of the plurality of driving units 3400 and the output unit 34020 use the voltage boost circuit 3440 and the voltage boost unit 3460, respectively, to provide individual voltages to their corresponding devices. Consequently, the stability of the output voltage of the driving unit 3400 is enhanced.

In addition to using individual supply voltages provided by the voltage boost circuit 3440 and voltage boost unit 3460, respectively, the differential units 34000 of the plurality of driving units 3400 and the output unit 34020 according to the present invention can also receive the second supply voltage $V_{P2}$ provided by the voltage boost unit 3460 simultaneously.

Figure 14:
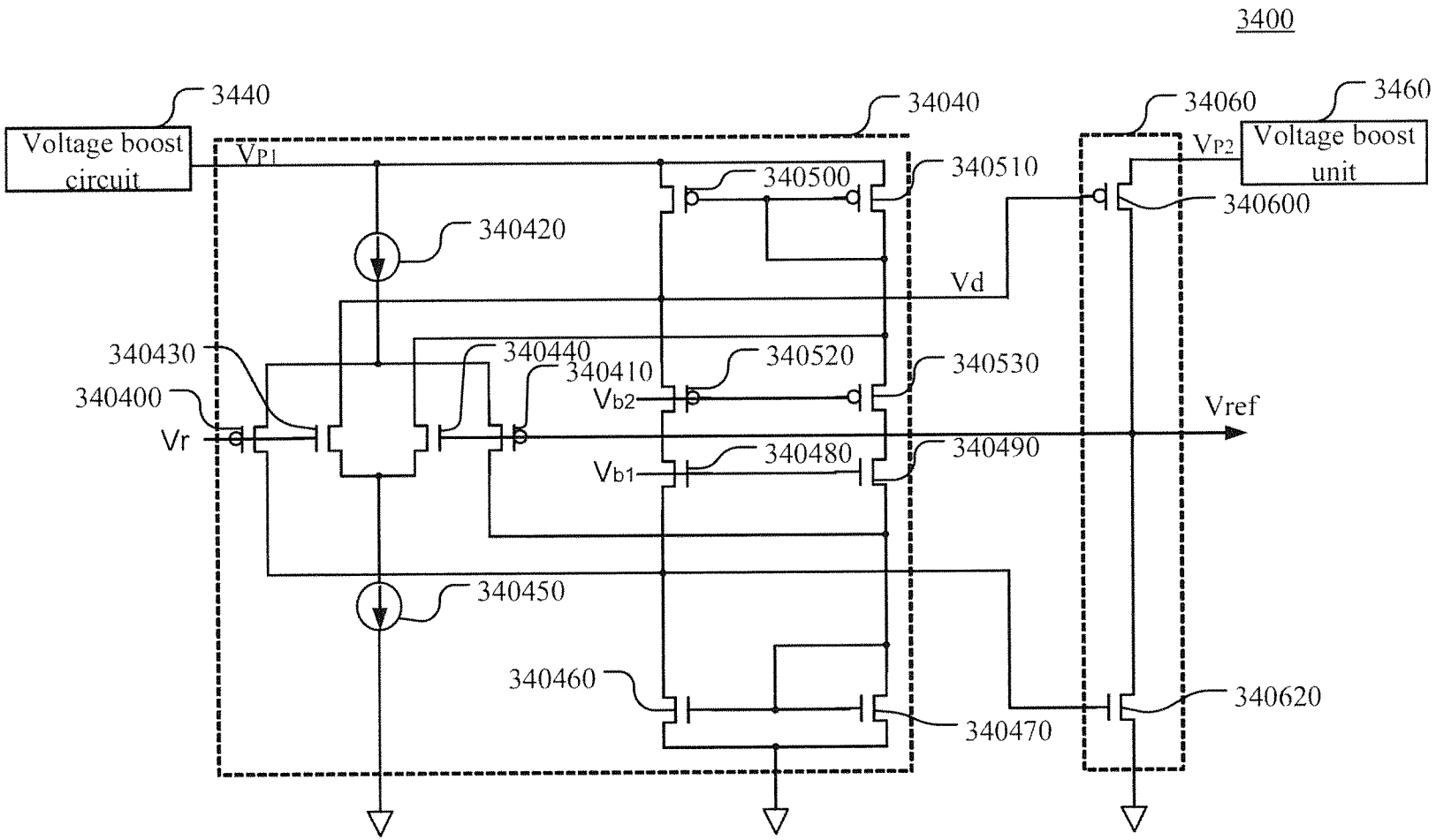
FIG. 14 shows a circuit diagram of the driving unit according a second embodiment of the present invention.

Please refer to FIG. 14, which shows a circuit diagram of the driving unit according a second embodiment of the present invention. As shown in the figure, the difference between the present embodiment and the one in FIG. 13 is that the driving unit 3400 according to the present embodiment adopts a rail-to-rail differential unit 34040. Thereby, the driving unit 3400 according to the present embodiment comprises the differential unit 34040 and an output unit 34060. The differential unit 34040 comprises transistors 340400~340530.

The gate of the transistor 340400 is coupled to the output of the gamma circuit 320. A first terminal of the transistor 340400 is coupled to a first terminal of the transistor 340410. A second terminal of the transistor 340400 is coupled between the transistor 340460 and the transistor 340480. The gate of the transistor 34041 is coupled to the output of the driving unit 3400. A second terminal of the transistor 340410 is coupled between the transistor 340470 and the transistor 340490. A first terminal of the current source 340420 is coupled to the first terminal of the transistor 340400 and the first terminal of the transistor 340410. A second terminal of the current source 340420 is coupled to the power supply for receiving the first supply voltage $V_{P1}$ provided by the voltage boost circuit 3440. The gate of the transistor 340430 is coupled to the output of the gamma circuit 320. A first terminal of the transistor 340430 is coupled to a first terminal of the transistor 340440. A second terminal of the transistor 340430 is coupled between the transistor 340500 and the transistor 340520. The gate of the transistor 340440 is coupled to the output of the driving unit 3400. A second terminal of the transistor 340440 is coupled between the transistor 340510 and the transistor 340530. A first terminal of the current source 340450 is coupled to the first terminal of the transistor 340430 and the first terminal of the transistor 340440. A second terminal of the current source 34045 is coupled to the reference voltage.

The gate of the transistor 340460 according to the present embodiment is coupled to the gate of the transistor 340470. A first terminal of the transistor 340460 is coupled to the reference voltage. A second terminal of the transistor 340460 is coupled to a first terminal of the transistor 340480. A first terminal of the transistor 340470 is coupled to the reference voltage. A second terminal of the transistor 340470 is coupled to the gate of the transistor 340470 and a first terminal of the transistor 340490. The gate of the transistor 340480 receives a first reference voltage $V_{b1}$. A second terminal of the transistor 340480 is coupled to a first terminal of the transistor 340520. The gate of the transistor 340490 receives the first reference voltage $V_{b1}$. A second terminal of the transistor 340490 is coupled to a first terminal of the transistor 340530.

The gate of the transistor 340500 is coupled to the gate of the transistor 340510. A first terminal of the transistor 340500 is coupled to a second terminal of the transistor 340520. A second terminal of the transistor 340500 is coupled to the power supply for receiving the first supply voltage $V_{P1}$ output by the voltage boost circuit 3440. A first terminal of the transistor 340510 is coupled to a second terminal of the transistor 340530 and the gate of the transistor 340510. A second terminal of the transistor 340510 is coupled to the power supply for receiving the first supply voltage $V_{P1}$ output by the voltage boost circuit 3440. The gates of the transistor 340520, 340530 receive a second reference voltage $V_{b2}$.

The output unit 34060 according to the present embodiment comprises a transistor 340600 and a transistor 340620. The gate of the transistor 340600 is coupled to the first terminal of the transistor 340500, the second terminal of the transistor 340520, and the second terminal of the transistor 340430. A first terminal of the transistor 340600 is coupled a first terminal of the transistor 340620 and the output of the driving unit 3400. A second terminal of the transistor 340600 is coupled to the power supply for receiving the second supply voltage $V_{P2}$ output by the voltage boost unit 3460. The gate of the transistor 340620 is coupled to the second terminal of the transistor 340460, the first terminal of transistor 340480, and the second terminal of the transistor 340400. A second terminal of the transistor 340620 is coupled to the reference voltage. Thereby, the influence of significant variation of output current due to the load on the power supply of the differential units 34040 of the plurality of driving units 3400, and hence on the levels of the differential voltage $V_d$ output by the differential units 34040, can be avoided. Accordingly, the differential units 3404 and the output units 34060 according to the present embodiment use individual voltages provided by the voltage boost circuit 3440 and the voltage boost unit 3460, respectively, for improving the stability of the voltages output by the driving units 3400.

Figure 15:
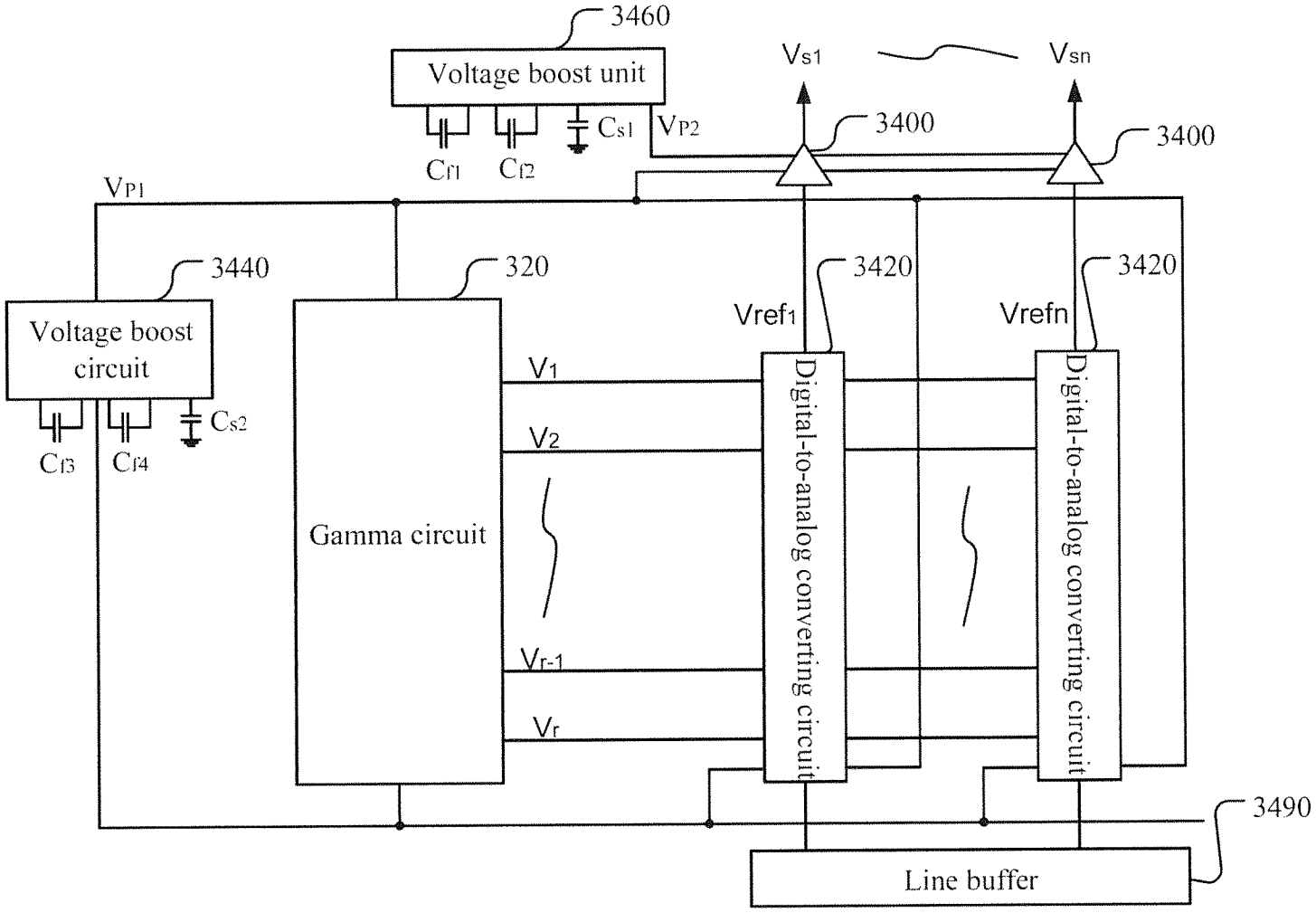
FIG. 15 shows a block diagram of the driving circuit of the display panel according to a fourth embodiment of the present invention.

Please refer to FIG. 15, which shows a block diagram of the driving circuit of the display panel according to a fourth embodiment of the present invention. As shown in the figure, the difference between the present embodiment and the one in FIG. 12 is that the locations of the plurality of driving units 3400 according to the present embodiment and the location of the plurality of digital-to-analog converting circuits 3420 are exchanged. In other words, the output of the gamma circuit 320 is coupled to the plurality of digital-to-analog converting circuits 3420; the outputs of the plurality of digital-to-analog converting circuits are coupled to the plurality of driving units 3400, respectively. Namely, the plurality of digital-to-analog converting circuit 3420 receive the plurality of gamma voltages $V_1$~$V_r$ of the gamma circuit 320 and select one of the plurality of gamma voltages $V_1$~$V_r$ as a reference driving voltage $V_{ref}$ according to the pixel data, respectively. The plurality of driving units 3400 receive the reference driving voltages $V_{ref1}$~$V_{refn}$ output by the plurality of digital-to-analog converting circuits 3420, respectively, produce a data driving voltage Vs according to the reference driving voltage $V_{ref}$, and transmit the data driving voltage Vs to the display panel 2 for displaying images. The voltage boost circuit 3440 and the voltage boost unit 3460 are identical to the embodiment in FIG. 12. Hence, the details will not be described again.

As the embodiment in FIG. 12, the plurality of driving units 3400 according to the present embodiment receive the first supply voltage $V_{P1}$ produced by the voltage boost circuit 3440 and the second supply voltage $V_{P2}$ produced by the voltage boost unit 3460 simultaneously. Take FIG. 13 for example. The differential unit 34000 receives the first supply voltage $V_{P1}$ and uses it as the power supply thereof; the output unit 34020 receives the second supply voltage $V_{P2}$ and uses it the power supply thereof. Accordingly, the differential units 34040 and the output units 34060 of the plurality of driving units in the driving circuit of a display panel according to the present embodiment can also use individual voltages provided by the voltage boost circuit 3440 and the voltage boost unit 3460, respectively, for improving the stability of the voltages output by the driving units 3400.

Figure 16:
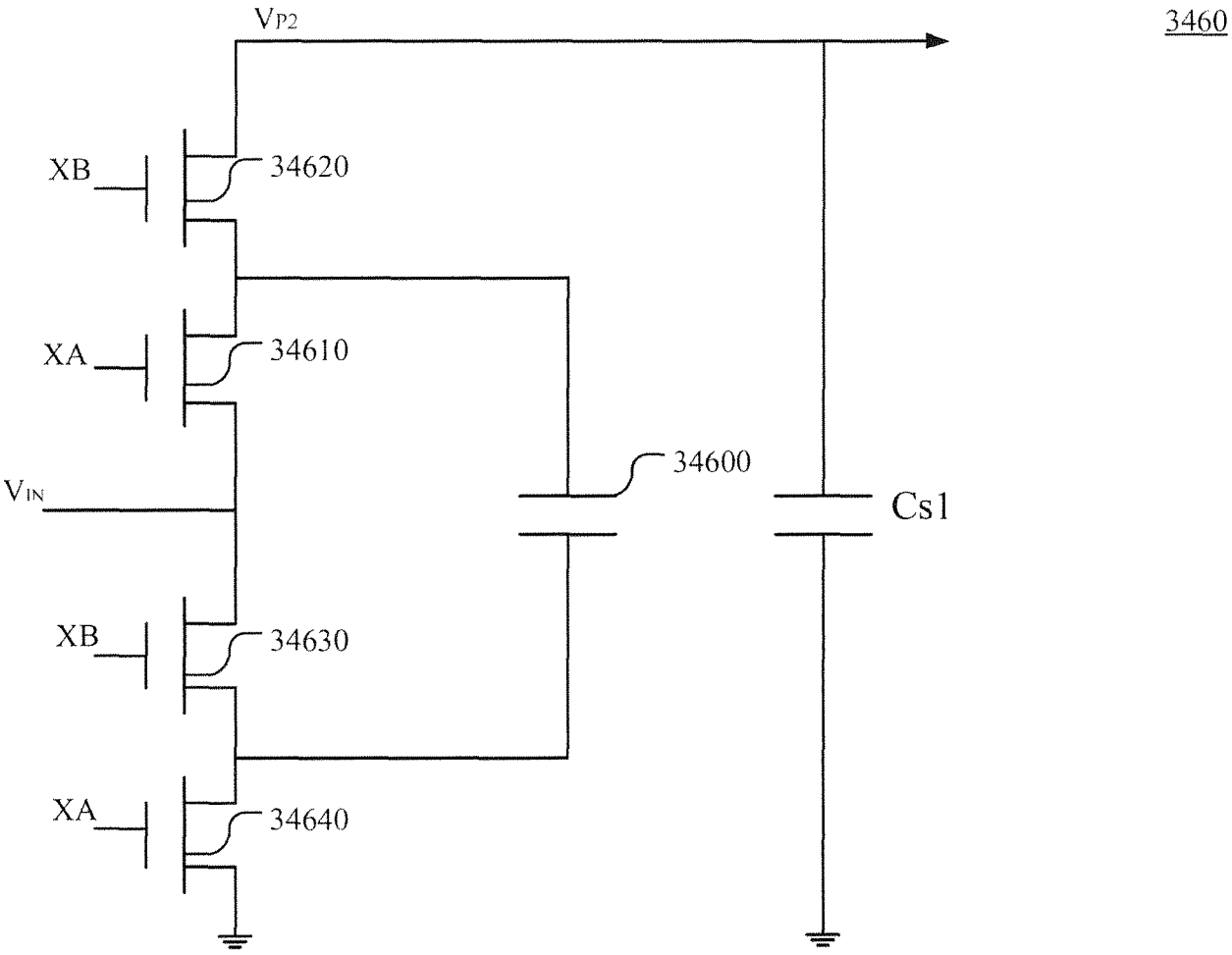
FIG. 16 shows a circuit diagram of the voltage boost unit according a first embodiment of the present invention.

Please refer to FIG. 16, which shows a circuit diagram of the voltage boost unit according a first embodiment of the present invention. As shown in the figure, the voltage boost unit 3460 according to the present embodiment can be capacitive voltage boost circuit. The voltage boost unit 3460 comprises a flying capacitor 34600, transistors 34610~34640, and a storage capacitor $C_{s1}$. The flying capacitor 34600 is used for producing the second supply voltage $V_{P2}$. A terminal of the transistor 34610 is coupled to a terminal of the flying capacitor 34600. The other terminal of the transistor 34610 receives an input voltage $V_{IN}$ and is controlled by a first control signal XA. The transistor 34620 is coupled to the flying capacitor 34600 and the transistor 34610 and controlled by a second control signal XB for outputting the second supply voltage $V_{P2}$. A terminal of the transistor 34630 is coupled to the other terminal of the flying capacitor 34600. The other terminal of the transistor 34630 receives the input voltage $V_{IN}$ and is controlled by the second control signal XB. A terminal of the transistor 34640 is coupled to the flying capacitor 3460 and the transistor 34630. The other terminal of the transistor 34640 is coupled to a ground and controlled by the first control signal XA. Besides, a terminal of the storage capacitor $C_{s1}$ is coupled to the transistor 34620; the other terminal of the storage capacitor $C_{s1}$ is coupled to the ground for storing and outputting the second supply voltage $V_{P2}$. Thereby, after receiving the input voltage $V_{IN}$, the voltage boost unit 346 according to the present embodiment uses the first control signal XA and the second control signal XB to control the transistors 34610~34640 for producing the second supply voltage $V_{P2}$ and outputting the second supply voltage $V_{P2}$ to the plurality of driving units 3400.

Figure 17:
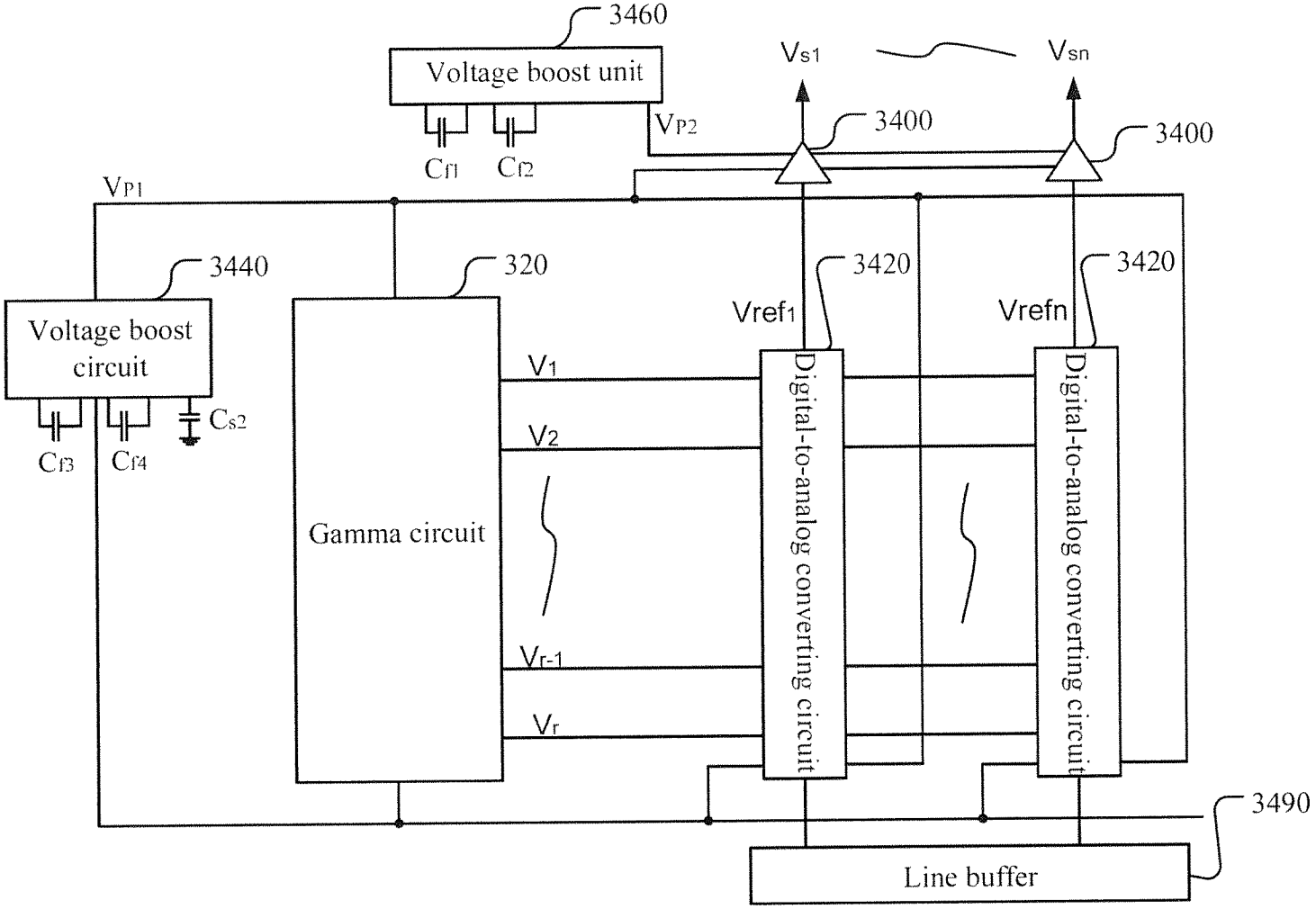
FIG. 17 shows a block diagram of the driving circuit of the display panel according to a fifth embodiment of the present invention.

Please refer to FIG. 17, which shows a block diagram of the driving circuit of the display panel according to a fifth embodiment of the present invention. As shown in the figure, the difference between the present embodiment and the previous one is that the voltage boost unit 3460 according to the present embodiment requires no storage capacitor $C_{s1}$. That is to say, there is a connecting path, without the storage capacitor $C_{s1}$ connected thereto, between the voltage boost unit 3460 and the plurality of driving units 3400, respectively. Furthermore, FIG. 10 can also adopt the design of the voltage boost unit 3460 without the storage capacitor $C_{s1}$. That is to say, there is a connecting path, without the storage capacitor $C_{s1}$ connected thereto, between the voltage boost unit 3460 and the plurality of driving units 3400. FIG. 12 can also adopt the design of the voltage boost units 3460, 3480 without the storage capacitors $C_{s1}$, $C_{s3}$. That is to say, there is a connecting path, without the storage capacitor $C_{s1}$ connected thereto, between the voltage boost unit 3460 and the plurality of driving units 3400; and there is a connecting path, without the storage capacitor $C_{s3}$ connected thereto, between the voltage boost unit 3480 and the plurality of driving units 3400.

Refer again to FIG. 13. The driving unit 3400 comprises the driving unit 34000 and the output unit 34020. Accordingly, the voltage boost unit 3460 in FIG. 11 requires no storage capacitor $C_{s1}$; it can be designed as having a connecting path, without the storage capacitor $C_{s1}$ connected thereto, between the voltage boost unit 3460 and the output unit 34020. Furthermore, FIG. 12 can also adopt the design of the voltage boost unit 3460 without the storage capacitor $C_{s1}$. That is to say, there is a connecting path, without the storage capacitor $C_{s1}$ connected thereto, between the voltage boost unit 3460 and the plurality of driving units 3400.

Besides, please refer to FIGS. 13 and 14 again. The driving unit 3400 comprises the differential units 34000, 34040 and the output units 34020, 34060. The voltage boost unit 3460 is coupled to the output units 34020, 34060 of the driving unit 3400. Thereby, there are connecting paths, without the storage capacitor $C_{s1}$ connected thereto, between the voltage boost unit 3460 and the output units 34020, 34060. In addition to the above embodiment, the voltage boost unit 3460 can also be coupled to the differential units 34000, 34040 of the driving unit 3400. Thereby, there are connecting paths, without the storage capacitor $C_{s1}$ connected thereto, between the voltage boost unit 3460 and the differential units 34000, 34040.

Figure 18:
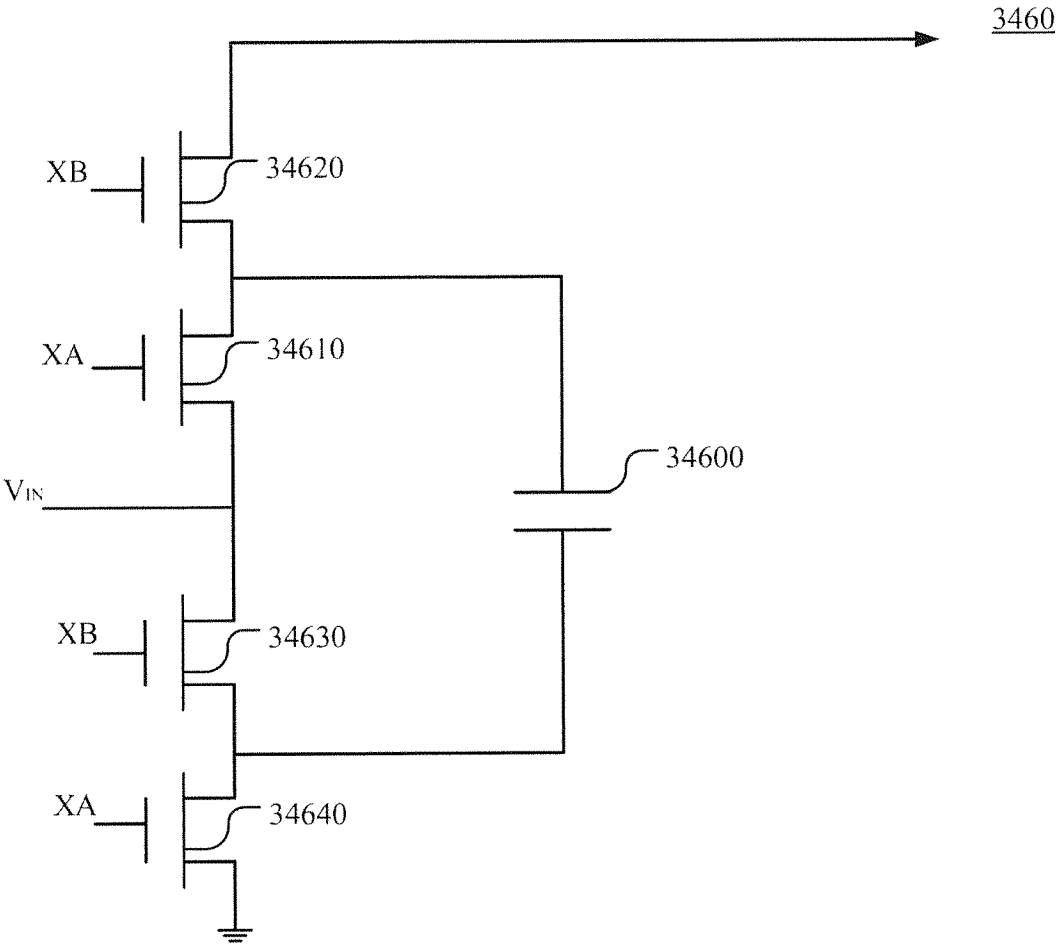
FIG. 18 shows a circuit diagram of the voltage boost unit according a second embodiment of the present invention.

Please refer to FIG. 18, which shows a circuit diagram of the voltage boost unit according a second embodiment of the present invention. As shown in the figure, the difference between the present embodiment and the one in FIG. 16 is that the voltage boost unit 3460 according to the present embodiment requires no storage capacitor $C_{s1}$. Because the voltage boost unit 3460 according to the present invention is used for providing the second supply voltage $V_{P2}$ of the plurality of driving units 3400, which need to drive the panel (as the display panel in FIG. 10) only and are not responsible for maintaining an accurate reference voltage for the digital-to-analog converting circuit (as the digital-to-analog converting circuit in FIG. 10), it is allowable that no storage capacitor is present and the power supply oscillates significantly. Hence, the voltage boost unit 3460 according to the present embodiment only needs the flying capacitor 34600 to produce the second supply voltage $V_{P2}$ and needs no external storage capacitor $C_{s1}$ for supplying the power required by the plurality of driving units 3400. Consequently, the circuit area, and hence the cost, can be reduced.

Figure 19:
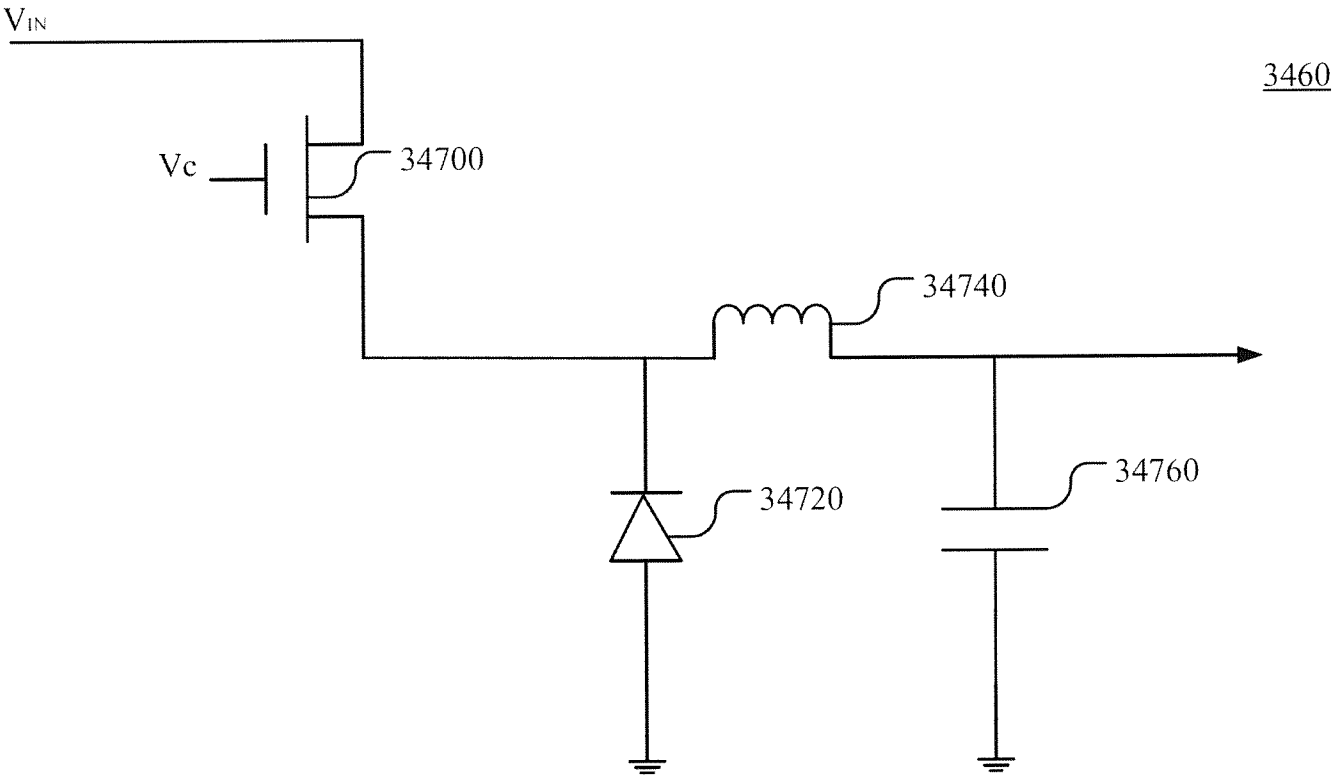
FIG. 19 shows a circuit diagram of the voltage boost unit according a third embodiment of the present invention.

Please refer to FIG. 19, which shows a circuit diagram of the voltage boost unit according a third embodiment of the present invention. As shown in the figure, the difference between the voltage boost unit 3460 according to the present embodiment and those according to the embodiments in FIGS. 17 and 18 is that the voltage boost unit 3460 according to the present embodiment is an inductive voltage boost unit. The voltage boost unit 3460 according to the present embodiment comprises a control transistor 34700, a diode 34720, a storage inductor 34740, and an output capacitor 34760. A terminal of the control transistor 34700 receives the input voltage $V_{IN}$ and is controlled by a control signal $V_C$. A terminal of the diode 34720 is coupled to the control transistor 34700. The other terminal of the diode 34720 is coupled to the ground. The storage inductor 34740 is coupled to the control transistor 34700 and the diode 34720 for storing the energy of the input voltage $V_{IN}$. Besides, a terminal of the output capacitor 34760 is coupled to the storage inductor 34740. The other terminal of the output capacitor 34760 is coupled to the ground for storing the energy of the input voltage $V_{IN}$, producing the second supply voltage $V_{P2}$, and outputting the second supply voltage $V_{P2}$ to the plurality of driving units 3400. In conclusion, the voltage boost unit 3460 according to the present invention is not limited a capacitive voltage boost unit and an inductive voltage boost unit. Those embodiments having the voltage boost circuit 3440 and the voltage boost unit 3460 producing the first supply voltage $V_{P1}$ and the second supply voltage $V_{P2}$, respectively, and transmitting the first supply voltage $V_{P1}$ and the second supply voltage $V_{P2}$ to the digital-to-analog converting circuits 3420 and the driving units 3400, respectively, are within the scope of the present invention.

Furthermore, because the plurality of analog-to-analog converting circuits 3420 and the plurality of driving units 3400 according to the present invention use different supply voltages provided by the voltage boost circuit 3440 and the voltage boost unit 3460, respectively, the output capacitor 34760 according to the present embodiment does need a large capacitance. Consequently, instead of connected externally, the output capacitor 34760 according to the present embodiment can be built in a chip. Hence, the circuit area can be saved.

Figure 20B:
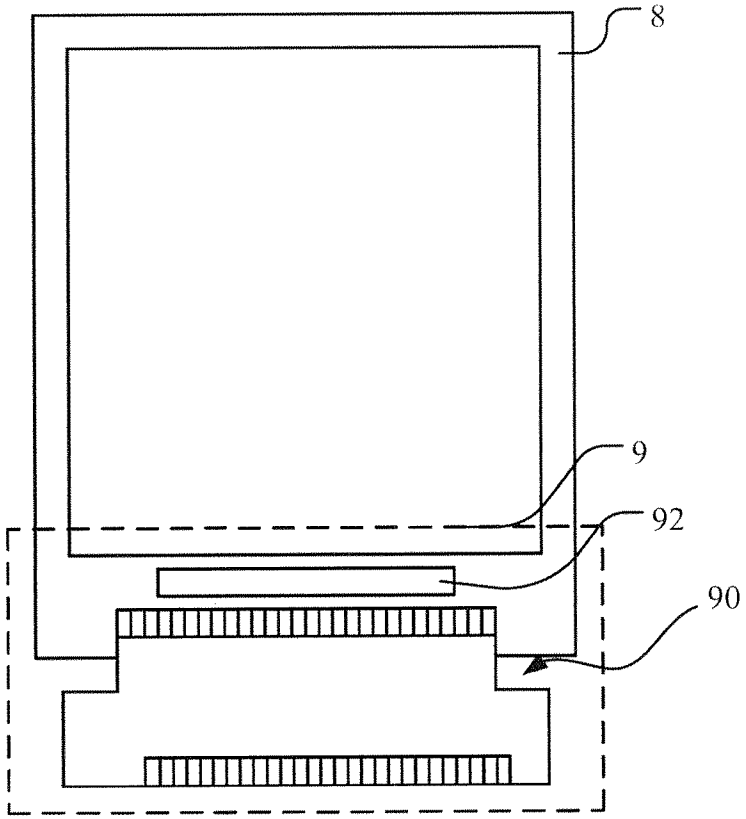
FIG. 20B shows a structural schematic diagram of the display module according to the present invention.
Figure 20A:
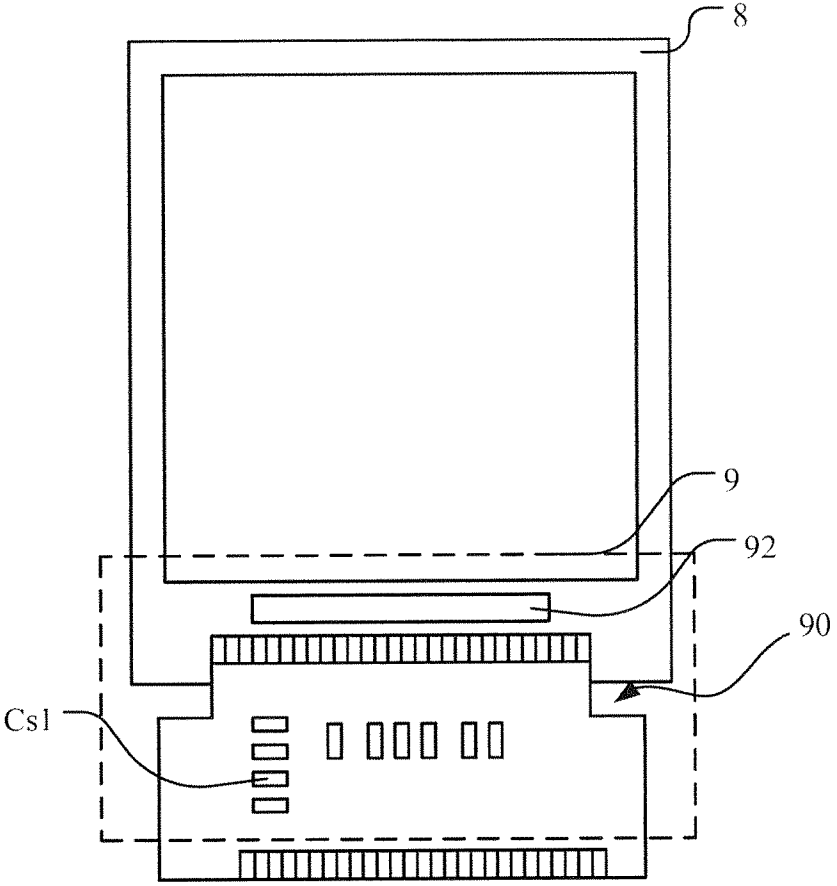
FIG. 20A shows a structural schematic diagram of the display module.

Please refer to FIG. 20A, which shows a structural schematic diagram of the display module. As shown in the figure, the display module comprises the display panel 2 and a driving module 9. The driving module 9 is connected electrically with the display panel 2 for driving the display panel 2 to display images. The driving module 9 comprises flexible circuit board 90 and a driving chip 92. The driving chip 92 is disposed on one side of the display panel 2 and connected electrically with the display panel 2. One side of the flexible circuit board 90 is connected to one side of the display panel 2 and connected electrically with the driving chip 92. According to the present embodiment, the storage capacitor $C_{s1}$ is connected externally to the flexible circuit board 90.

Please refer to FIG. 20B, which shows a structural schematic diagram of the display module according to the present invention. As shown in the figure, the difference between the present embodiment and the one in FIG. 20A is that the driving chip 92 according to the present embodiment comprises the plurality of driving units 3400, the plurality of digital-to-analog converting circuits 3420, the voltage boost circuit 3440, and the voltage boost unit 3460. The connections and operations among the plurality of driving units 3400, the plurality of digital-to-analog converting circuits 3420, the voltage boost circuit 3440, and the voltage boost unit 3460 are described above and will not be repeated here again. Because the plurality of analog-to-analog converting circuits 3420 and the plurality of driving units 3400 according to the present invention use individual supply voltages provided by the voltage boost circuit 3440 and the voltage boost unit 3460, respectively, the storage capacitor $C_{s1}$ required by the driving chip 92 can be shrunk drastically and disposed directly in the driving chip 92. It is not necessary to connect the storage capacitor $C_{s1}$ externally to the flexible circuit board 90, or the driving chip 92 even requires no external storage capacitor. Thereby, the circuit area can be saved, and thus achieving the purpose of saving cost.

Figure 21:
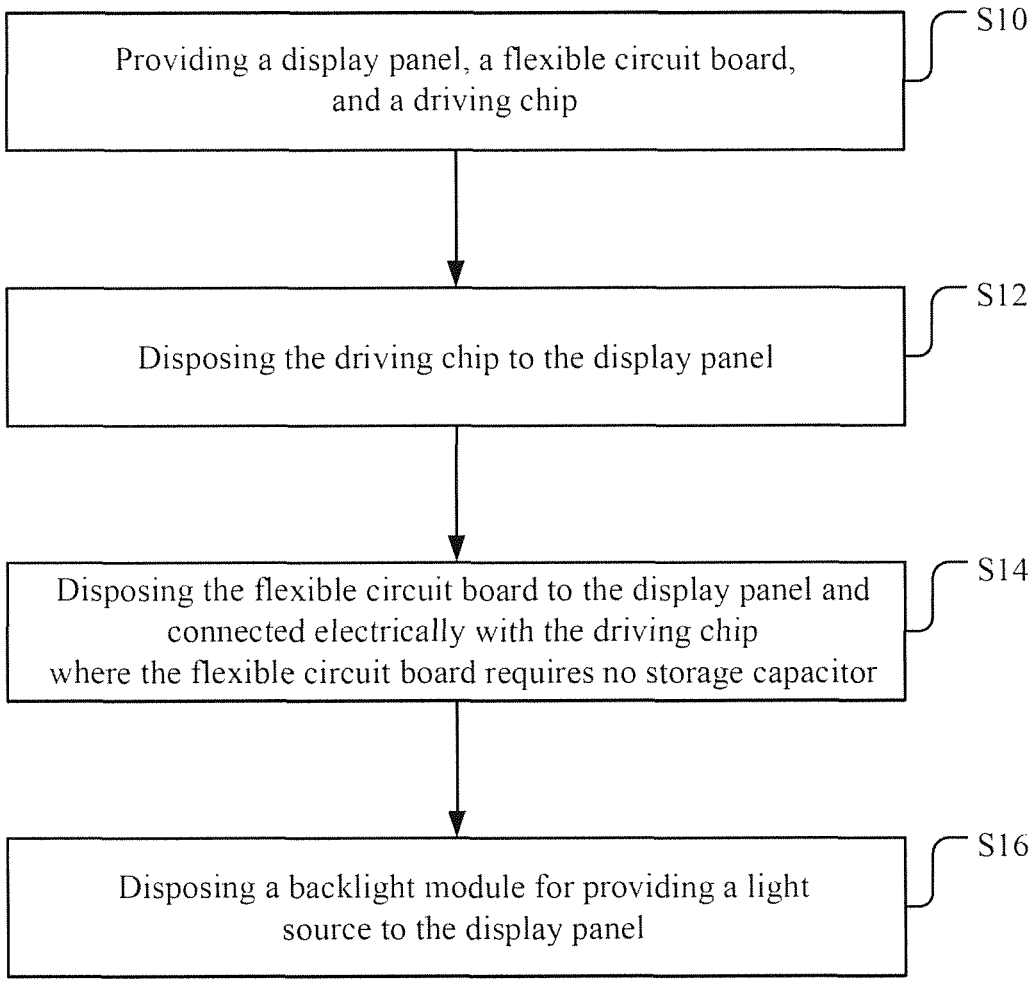
FIG. 21 shows a flowchart of the method for manufacturing the display panel.

Please refer to FIG. 21, which shows a flowchart of the method for manufacturing the display panel. As shown in the figure, first, the step S10 is executed for providing the display panel 2, the flexible circuit board 90, and the driving chip 92. Then, the step S12 is executed for disposing the driving chip 92 to the display panel 2, as shown in FIG. 20A. Next, the step S14 is executed for disposing the flexible circuit board 90 to the display panel and connected electrically with the driving chip 2. In addition, it is necessary to dispose a storage capacitor $C_{s1}$ on the flexible circuit board 90, as shown in FIG. 20B.

Accordingly, because the plurality of analog-to-analog converting circuits 3420 and the plurality of driving units 3400 according to the present invention use individual supply voltages provided by the voltage boost circuit 3440 and the voltage boost unit 3460, respectively, the storage capacitor $C_{s1}$ required by the driving chip 92 can be shrunk drastically and disposed directly in the driving chip 92. It is not necessary to connect the storage capacitor $C_{s1}$ externally to the flexible circuit board 90, or the driving chip 92, namely, the driving circuit, even requires no external storage capacitor. Thereby, according to the present invention, the process of connecting the storage capacitor externally to the flexible circuit board 90 can be saved and thus shortening the process time and further saving cost.

Moreover, the method for manufacturing the display panel according to the present invention further comprises a step S16 for disposing a backlight module (not shown in the figure) for providing a light source to the display panel 2.

To sum up, the area-saving driving circuit for a display panel according to the present invention comprises a plurality of digital-to-analog converting circuits, a plurality of driving units, and a plurality of voltage booster units. The plurality of digital-to-analog converting circuits convert input data, respectively, and produce a pixel signal. The plurality of driving units are coupled to the plurality of digital-to-analog converting circuits, respectively. They produce a driving signal according to the pixel signal and transmit the driving signal to the display panel for displaying. In addition, the plurality of voltage booster units are coupled to the plurality of driving units, respectively, and produce a supply voltage according to a control signal. Then the supply voltage is provided to the plurality of driving units. Thereby, by providing the supply voltage to the plurality of driving units of the display panel by means of the plurality of voltage booster units, the area of the external storage capacitor is reduced. Alternative, the external storage capacitor can be even not required. Hence, the purpose of saving circuit area can be achieved.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit of a display panel, comprising:

a gamma circuit, producing a plurality of gamma voltages;

a plurality of driving units, producing a reference driving voltage according to one of said gamma voltages, respectively;

a line buffer providing a plurality of pixel data;

a plurality of digital-to-analog converting circuits, receiving said reference driving voltage output by said plurality of driving units, selecting one of said plurality of reference driving voltages as a data driving voltage according to said pixel data, respectively, and transmitting said plurality of data driving voltages to said display panel, each of said driving units coupled in series between said gamma circuit and a respective one of said plurality of digital-to-analog converting circuits;

a voltage boost circuit, used for producing a first supply voltage, and providing said first supply voltage to said plurality of digital-to-analog converting circuits through a first output line, said plurality of digital-to-analog converting circuits being powered by said first supply voltage;

at least a voltage boost unit, independent of said voltage boost circuit, used for producing a second supply voltage, and providing said second supply voltage to said plurality of driving units through a second output line being independent of said first output line, said plurality of driving units being powered by said second supply voltage; and said gamma circuit, said plurality of driving units, said plurality of digital-to-analog converting circuits and said at least one voltage boost unit being encapsulated in a driving chip for coupling to said display panel.

2. The driving circuit of claim 1, wherein each of said plurality of driving units comprises:

a differential unit, receiving said first supply voltage as the power supply, and producing a differential voltage according to said gamma voltage; and an output unit, receiving said second supply voltage as the power supply, and producing said reference driving voltage according to said differential voltage.

3. The driving circuit of claim 2, wherein there is a connecting path between said voltage boost unit and said output unit, and no storage capacitor is connected to said connecting path.

4. The driving circuit of claim 1, wherein each of said plurality of driving units comprises:

a differential unit, receiving said second supply voltage as the power supply, and producing a differential voltage according to said gamma voltage; and an output unit, receiving said second supply voltage as the power supply, and producing said reference driving voltage according to said differential voltage.

5. The driving circuit of claim 4, wherein there is a connecting path between said voltage boost unit and said output unit and between said voltage boost unit and said differential unit, respectively, and no storage capacitor is connected to said connecting path.

6. The driving circuit of claim 1, wherein said voltage boost unit requires no storage capacitor.

7. The driving circuit of claim 6, wherein there is a connecting path between said voltage boost unit and said plurality of driving units, and no storage capacitor is connected to said connecting path.

8. A driving circuit of a display panel, comprising:

a gamma circuit, producing a plurality of gamma voltages;

a plurality of driving units, producing a reference driving voltage according to one of said gamma voltages, respectively;

a line buffer providing a plurality of pixel data;

a plurality of digital-to-analog converting circuits, receiving said reference driving voltage output by said plurality of driving units, selecting one of said plurality of reference driving voltages as a data driving voltage according to said pixel data, respectively, and transmitting said plurality of data driving voltages to said display panel, each of said driving units coupled in series between said gamma circuit and a respective one of said plurality of digital-to-analog converting circuits;

a voltage boost circuit, used for producing a first supply voltage, and providing said first supply voltage to said plurality of digital-to-analog converting circuits through a first output line, said plurality of digital-to-analog converting circuits being powered by said first supply voltage;

a plurality of voltage boost units, independent of said voltage boost circuit, used for producing a second supply voltage, and providing said second supply voltage to said plurality of driving units through a second output line being independent of said first output line, said plurality of driving units being powered by said second supply voltage; and said gamma circuit, said plurality of driving units, said plurality of digital-to-analog converting circuits and said voltage boost units being encapsulated in a driving chip for coupling to said display panel.

9. The driving circuit of claim 8, wherein each of said plurality of driving units comprises:

a differential unit, receiving said first supply voltage as the power supply, and producing a differential voltage according to said gamma voltage; and an output unit, receiving said second supply voltage as the power supply, and producing said reference driving voltage according to said differential voltage.

10. The driving circuit of claim 8, wherein each of said plurality of driving units comprises:

a differential unit, receiving said second supply voltage as the power supply, and producing a differential voltage according to said gamma voltage; and an output unit, receiving said second supply voltage as the power supply, and producing said reference driving voltage according to said differential voltage.

11. The driving circuit of claim 8, wherein said plurality of voltage boost units require no storage capacitor.

12. A driving module of a display panel, comprising:

a flexible circuit board, connected electrically with said display panel; and a driving chip, disposed on one side of said flexible circuit board, and comprising:

a gamma circuit, producing plurality of a gamma voltages;

a plurality of driving units, producing a reference driving voltage according to one of said gamma voltages, respectively;

a line buffer providing a plurality of pixel data;

a plurality of digital-to-analog converting circuits, receiving said reference driving voltage output by said plurality of driving units, selecting one of said plurality of reference driving voltages as a data driving voltage according to said pixel data, respectively, and transmitting said plurality of data driving voltages to said display panel for displaying images, each of said driving units coupled in series between said gamma circuit and said plurality of digital-to-analog converting circuits;

a voltage boost circuit, used for producing a first supply voltage, and providing said first supply voltage to said plurality of digital-to-analog converting circuits through a first output line, said plurality of digital-to-analog converting circuits being powered by said first supply voltage;

at least a voltage boost unit, independent of said voltage boost circuit, used for producing a second supply voltage, and providing said second supply voltage to said plurality of driving units through a second output line being independent of said first output line, said plurality of driving units being powered by said second supply voltage; and said gamma circuit, said plurality of driving units, said plurality of digital-to-analog converting circuits and said at least one voltage boost unit being encapsulated in said driving chip for coupling to said display panel.

13. A display device, comprising:

a display panel, used for displaying an image;

a flexible circuit board, connected electrically with said display panel; and a driving chip, disposed on one side of said flexible circuit board, producing a plurality of data driving voltages to said display panel for displaying said image, and comprising:

a gamma circuit, producing a plurality of gamma voltages;

a plurality of driving units, producing a reference driving voltage according to one of said plurality of gamma voltages, respectively;

a line buffer providing a plurality of pixel data;

a plurality of digital-to-analog converting circuits, receiving said reference driving voltage output by said plurality of driving units, selecting one of said plurality of reference driving voltages as a data driving voltage according to said pixel data, respectively, and transmitting said plurality of data driving voltages to said display panel, each of said driving units coupled in series between said gamma circuit and said plurality of digital-to-analog converting circuits;

a voltage boost circuit, used for producing a first supply voltage, and providing said first supply voltage to said plurality of digital-to-analog converting circuits through a first output line, said plurality of digital-to-analog converting circuits being powered by said first supply voltage;

at least a voltage boost unit, independent of said voltage boost circuit, used for producing a second supply voltage, and providing said second supply voltage to said plurality of driving units through a second output line being independent of said first output line, said plurality of driving units being powered by said second supply voltage; and said gamma circuit, said plurality of driving units, said plurality of digital-to-analog converting circuits and said at least one voltage boost unit being encapsulated in said driving chip for coupling to said display panel.

14. A driving circuit of a display panel, comprising:

a gamma circuit, producing a plurality of gamma voltages;

a line buffer providing a plurality of pixel data;

a plurality of digital-to-analog converting circuits, receiving said plurality of gamma voltages, and selecting one of said plurality of gamma voltages as a reference driving voltage according to said pixel data, respectively;

a plurality of driving units, receiving said reference driving voltage output by said plurality of digital-to-analog converting circuits, producing a data driving voltage according to said reference driving voltage, respectively, and transmitting said data driving voltage to said display panel for displaying images;

a voltage boost circuit, used for producing a first supply voltage, and providing said first supply voltage to said plurality of digital-to-analog converting circuits through a first output line, said plurality of digital-to-analog converting circuits being powered by said first supply voltage;

at least a voltage boost unit, independent of said voltage boost circuit, used for producing a second supply voltage, and providing said second supply voltage to said plurality of driving units through a second output line being independent of said first output line, said plurality of driving units being powered by said second supply voltage; and said gamma circuit, said plurality of driving units, said plurality of digital-to-analog converting circuits and said at least one voltage boost unit being encapsulated in a driving chip for coupling to said display panel;

where each of said plurality of driving units comprises:

a differential unit, receiving said first supply voltage as the power supply, and producing a differential voltage according to said reference driving voltage; and an output unit, receiving said second supply voltage as the power supply, and producing said data driving voltage according to said differential voltage.

* * * * *